US005603188A

United States Patent [19]

Robbin

[11] Patent Number: 5,603,188

[45] Date of Patent: Feb. 18, 1997

[54] ARCHITECTURAL BODY HAVING A QUASICRYSTAL STRUCTURE

[76] Inventor: Anthony S. Robbin, 423 Broome St., New York, N.Y. 10013

[21] Appl. No.: 95,371

[22] Filed: Jul. 8, 1993

Related U.S. Application Data

[63] Continuation of Ser. No. 877,972, May 4, 1992, abandoned, which is a continuation of Ser. No. 429,933, Oct. 31, 1989, abandoned.

[51] Int. Cl.[6] ..... E04B 7/08

[52] U.S. Cl. ..... 52/81.1; 52/DIG. 10

[58] Field of Search ..... 52/646, 648, DIG. 10, 52/81

[56] References Cited

U.S. PATENT DOCUMENTS 3,722,153 3/1973 Baer .
4,723,382 2/1988 Lalvani .

OTHER PUBLICATIONS

"Quasicrystals," David Nelson, Scientific American, pp. 43 through 57, Aug. 1986.

"Quasicrystals," Paul Joseph Steinhardt, American Scientist, vol. 74, pp. 586 through 597, Nov. – Dec. 1986.

"Quasicrystals with arbitrary orientational symmetry," Joshua E. S. Socolar, Paul J. Steinhardt, and Dov Levine (Socolar), Physical Review B, vol. 32, No. 8, pp. 5547 through 5550, Oct. 15, 1985.

*Primary Examiner*—Creighton Smith
*Attorney, Agent, or Firm*—Keck, Mahin & Cate

[57] ABSTRACT

An architectural body having a quasicrystal structure formed from a lattice framework, plate framework, or lattice-membrane framework. The lattice framework comprises elongated members connected at nodes corresponding to computer generated vertex positions from a computer program. The plate framework comprises rhombus shaped plates formed into cells of either an acute rhombic hexahedron or an obtuse rhombic hexahedron. The cells are fastened together to form the quasicrystal structure. The lattice-membrane structure is formed by a lattice framework which is then covered by a tensile membrane.

15 Claims, 5 Drawing Sheets

ARCHITECTURAL BODY HAVING A QUASICRYSTAL STRUCTURE

This is a continuation of application Ser. No. 07/877,972, filed May 4, 1992, now abandoned, which is a Rule 60 continuation of Ser. No. 07/429,933, filed Oct. 31, 1989, now abandoned.

FIELD OF THE INVENTION

The present invention generally relates to an architectural body such as domes, space frames, vaults and spheres, having a quasicrystal structure and specifically to lattice, plate and lattice-membrane bodies having quasicrystal structures.

BACKGROUND OF THE INVENTION

As is well known in the art, a crystal obeys properties such that there is a regular repeating internal arrangement of atoms. In addition, crystals obey two types of long-range orders. First, a crystal has orientational order, wherein all sides of the hexagonal faces of the crystal are parallel. Second, a crystal has translational order wherein parallel lines connecting the atoms of the crystal are spaced evenly.

Quasicrystals, on the other hand, have the same kind of order that is inherent in a crystal, but are also symmetrical in ways that are not displayed by a crystalline substance. While a crystal has threefold rotational symmetry, and sometimes fourfold and sixfold rotational symmetry, a crystal can never have fivefold rotational symmetry. By contrast, the quasicrystal has threefold, fourfold and fivefold symmetry. It has been discovered that a cold sample of an aluminum-manganese alloy obeys properties of both metallic crystal structures and glassy random structures. Prior hereto, quasicrystal structures exist only as mathematical models or atomic arrangements.

An article entitled "Quasicrystals" by David R. Nelson in the August 1986 issue of *Scientific American*, pages 43–51, describes the progress of the technology. In addition, a paper by Joshua E. Socolar and Paul J. Steinhardt describes how two ideal quasicrystal structures with identical orientational symmetry and unit can be constructed from diverse local configurations of cells. This paper is entitled "Quasicrystals. II. Unit-cell Configurations", and is found in the *The American Physical Society*, Jul. 15, 1986 issue, volume 34, number 2, at pages 617–633.

There have been structures designed having particular geometric characteristics which approach but fall short of quasicrystal characteristics. See, for example, U.S. Pat. No. 3,611,620 to Perry, which discloses toy blocks in rhombic hexahedra form which fit together to make geometric shapes such as the rhombic dodecahedron. In addition, U.S. Pat. No. 3,722,153 to Baer discloses a structural system having five-fold symmetries of the icosahedron and the dodecahedron. However, neither the Perry and Baer patents disclose structures having quasicrystal characteristics and features.

The present invention recognizes and utilizes the structural and visual advantages of quasicrystal structures to architectural bodies.

SUMMARY OF THE INVENTION

It is a primary object of the present invention to provide an architectural body having a quasicrystal structure.

The present invention relates to an architectural body having quasicrystal structure, for example, such as a dome, space frame, vault, or sphere. The architectural body has special structural and visual properties for use in architecture, engineering, indoor and outdoor artworks of all scales, and jewelry/object art.

In one form, the architectural body of the present invention is constructed of solid pentagonal dodecahedra having holes in the center of each of the twelve pentagonal faces. A dodecahedra is a solid having twelve plane faces and that are either equal pentagonal faces or equal rhombic faces. The solid pentagonal dodecahedra are used as hubs for the interconnection of linear members for the construction of nonrepeating lattices. The quasicrystal architectural body is constructed in many ways including a lattice structure, plate structure, and lattice-membrane structure.

Two kinds of effects are exhibited by the quasicrystal structure in an architectural body. First, the visual effects of structures have pure and genuine icosahedral symmetry. The structure appears to be made out of three sided, four sided, or five sided components depending on the perspective one views the structure. This multiplicity of reading occurs no matter where one stands in relation to the structure. In addition, this effect is also exhibited in the shadows casted by the structure, which change back and forth as the sun or other sources of lighting moves relative to the structure.

The second effect of quasicrystal architecture is in the structural nature of quasicrystals. For example, in the embodiment wherein the structure is formed as a lattice, the structure is flexible and not triangulated. The only rigid qualities of the structure are in the space frame connectors. In addition, in the embodiment where the architectural body is a lattice-membrane structure, the nonrepeating nature of the quasicrystal ensures that no load is translated through the structure but rather is diffused throughout the structure to the encompassing tensile membrane. Finally, where the architectural body is made with plates, the dodecahedral nodes, which are expensive to make and must withstand stress, are not needed. Plates provide both structure and shelter and are joined to transfer shear force from one plate to another.

The above and other objects and advantages will become more readily apparent when reference is made to the following description taking in conjunction with the accompanying drawings.

DETAILED DESCRIPTION OF THE PREFERRED EMBODIMENTS

While the following description relates to architectural bodies having quasicrystal structure, the same principles can be applied to many other types of structures on both a larger scale and a smaller scale.

As background information for describing the present invention, reference is first made to a computer program algorithm in the appendix that is used for making a mathematical model of a quasicrystal. This computer program generates the coordinate positions of the vertices and connect arrays for the quasicrystal architectural bodies according to the present invention. The algorithm computes the spatial arrangement of cubes or cells having vertices and provides as output, among other data, a table of vertices and table of connect arrays constituting a cell and for defining the precise spatial arrangement of the cells. Thus, the cells can be formed by the connection of elongated linear members according to the vertices and connect array data. The connect array establishes which node and linear member connects to another particular linear member. For example, it may be desired to select all cells having a positive y component that are at a given distance from the origin, to create a dome. The coordinates of these particular cells are then used in an architectural drawing or in an architectural program to generate architectural drawings of the structure.

The computer program is in Pascal and runs on an IBM-PC or other compatible computer. The program uses the deBruijn's dual method of first constructing a topological net or substructure, and then filling the net with cells.

The star matrix referred to in the program is the six axis of symmetry for the dodecahedron and the icosahedron. Procedure DT is a standard matrix multiplication routine. Direc and FindK are sifting algorithms.

The Intsect and Rhombus routines are the heart of the program. Intsect takes 3 planes normal to the star rays of the star vector matrix, finds their intersection point in terms of the Cartesian coordinate system, and then by projecting these points onto the other three star rays, finds the six planes normal to the star vector that define a cell. The Fill routine is a looping procedure that insures all of the cells are so discovered. The results of the algorithms are two cells used to form the quasicrystal as will be described in detail hereinafter. The data describing these cells can then be stored in a database including information of the vertices of the cells. Thus, two cells are positioned geometrically in ways to form a body having a quasicrystal structure.

Figure 1:
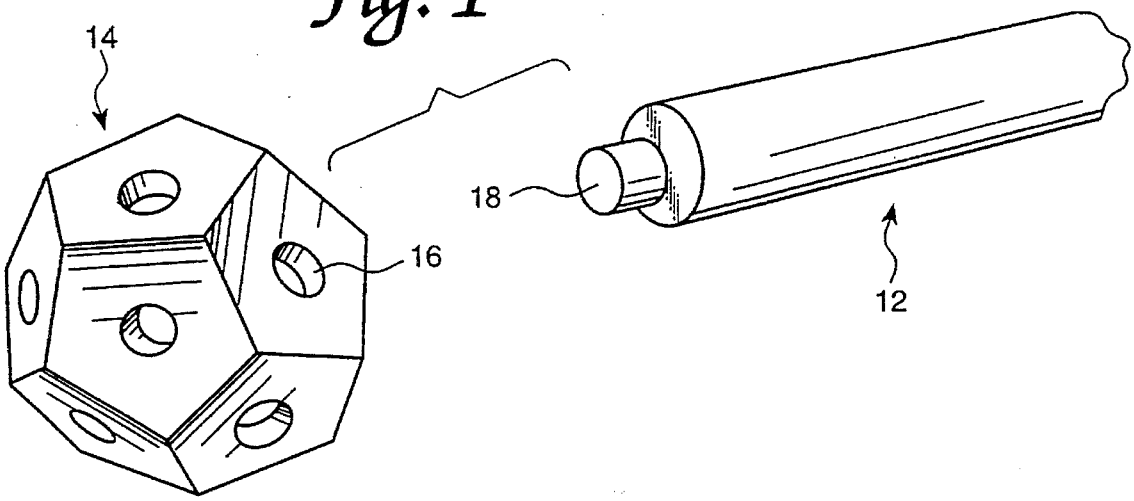
FIG. 1 is a perspective view of a dodecahedral node used in the construction of a quasicrystal lattice structure in accordance with the first embodiment of the present invention.
Figure 2A:
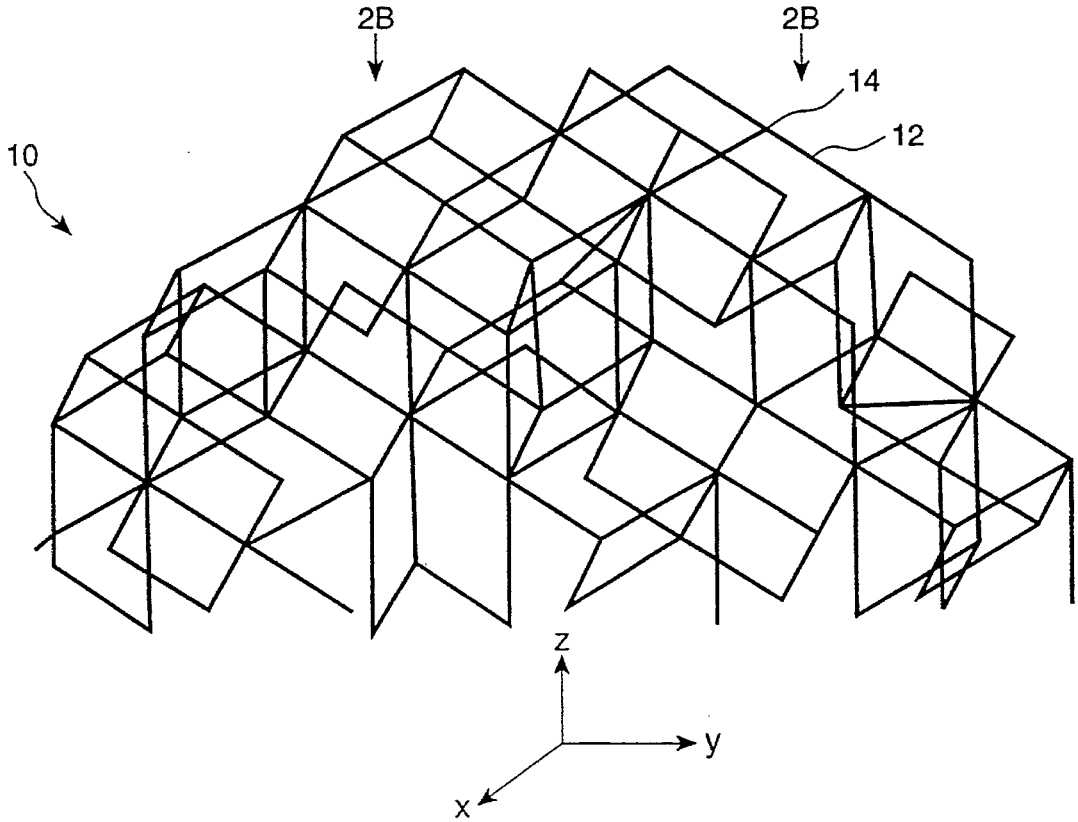
FIG. 2A is a side view of a dome having a quasicrystal lattice framework structure according to the first embodiment of the present invention and illustrating the interconnection of elongated members of the framework.

FIGS. 1 and 2A illustrate a quasicrystal architectural body having a lattice framework. This body can be built with either tensile or non-tensile materials (for example non-metallic materials) and yet have greater flexibility than existing lattice structures, and flexibility to withstand displacement due to wind, temperature change, and earthquakes.

The computer program provides as output a table of vertices and a connect array for the dome which is generally shown at 10 in FIG. 2A. The dome 10 is comprised of elongated linear members 12 connected at nodes 14.

FIG. 1 shows the elongated member 12 and dodecahedral connecting nodes 14 in greater detail. The connecting node 14 is a dodecahedral body having holes 16 in the center of each of its pentagonal faces for receiving a connecting pin 18 at the end of the elongated member 12. It is essential that the elongated members 12 are in this arrangement, connected by the dodecahedral connecting node 14, connected in the proper connect arrays, and connected at the appropriate vertices generated by the computer program. Tables A1 and A2 in the appendix list the coordinate values for the dome 10. Table A1 lists the coordinates of the nodes and Table A2 lists the connect array information. By connecting the elongated members 12 at these points with the dodecahedral nodes 14, it is ensured that the cells generated by the computer program are constructed and geometrically positioned so that a quasicrystal structure is created. The origin from which these coordinates correspond is shown in FIG. 2A.

Referring to the tables A1 and A2, the computer generated information will be described in greater detail. Table A1 lists four columns: one column being the nodes assigned by number to three columns listing the spatial position of that node. Table A2 lists three columns. The first column is the designation of a particular linear member. The second and third columns designate the nodes between which a particular linear member ids connected. For example, the first entry means that linear member 1 is connected between node 1 and node 47.

A cell is defined by a cube formed from the interconnection of the elongated members. However, the precise designation of a cell is not important in this embodiment since the lattice framework is easier to contruct by the precise interconnection of elongated members rather than the precise connection of cubes which is done in the second embodiment of this invention.

Due to the nature of a quasicrystal lattice structure, flexibility can be maintained throughout the structure when built with tensile or non-tensile materials even though quasicrystal lattices by their nature are not tensile. They do not stand primarily by the tension forces along the tensile members but rather are more like springs which have the resistance to flex at each member, compounded by the arrangement of the members, to produce the stiffness of the structure. Consequently, concrete compounds having shear strength and typically used to make springs and which are cheaper than metal (and are non-magnetic and non-conductive), could be precasted into the shapes described by the table of vertices and connect array information to form, for example, a quasicrystal lattice dome 10.

Figure 2B:
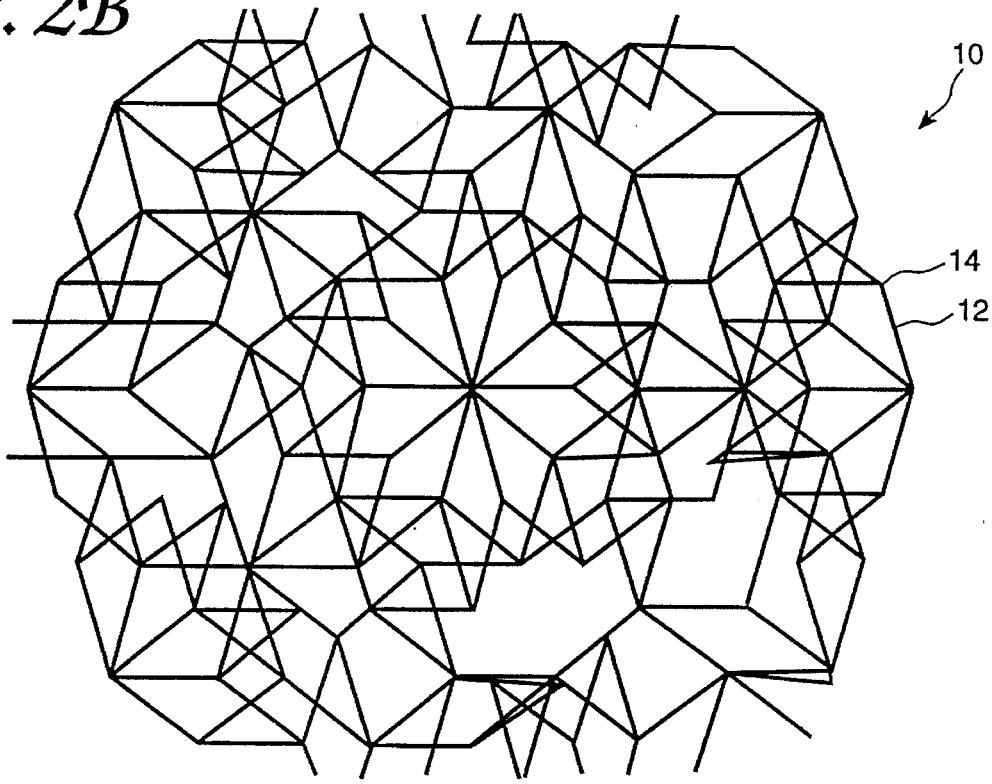
FIG. 2B is a top elevational view as seen from line 2B—2B of FIG. 2A and illustrating the interconnection of the elongated members directly above the dome and also illustrating the shadow of the dome when the sun is directly overhead of the dome illustrated in FIG. 2A.

FIG. 2B is a top view of the dome 10 as seen from the position of the sun at noon, and indicated by the circle 15 in FIG. 2A. This view illustrates the interconnection of the elongated members and the shadow pattern cast by the dome when the sun is directly overhead.

Figure 2C:
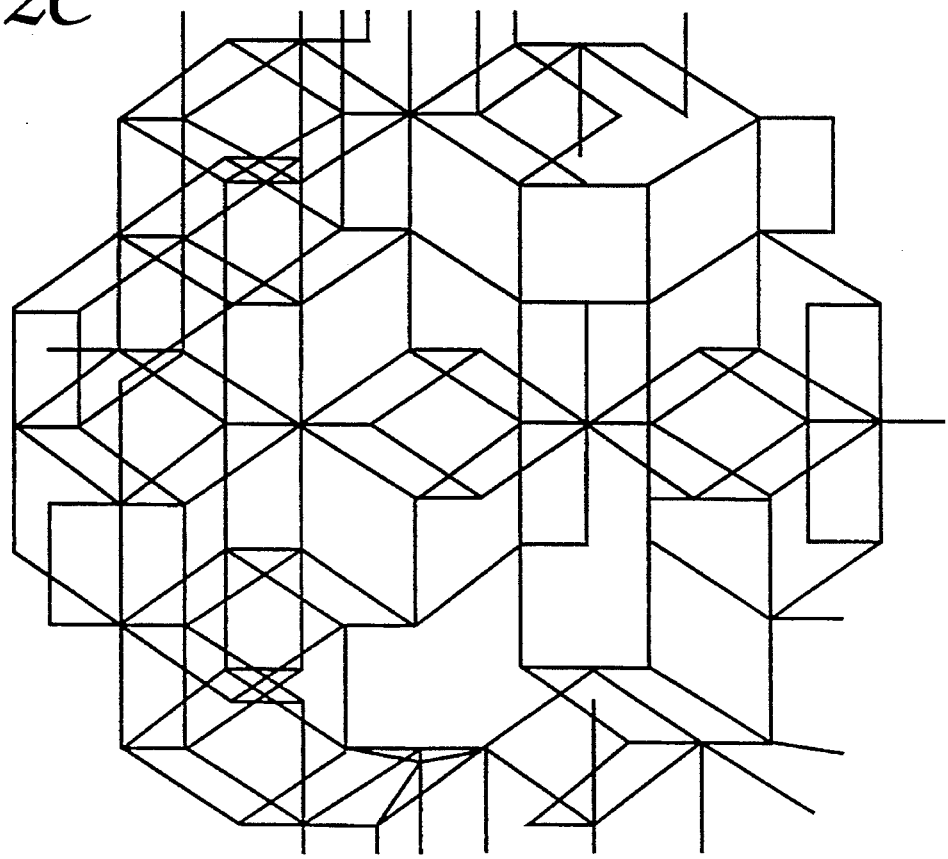
FIG. 2C illustrates the shadow pattern cast by the dome illustrated in FIG. 2A when the sun is approximately 19 degrees before noon.

FIG. 2C is a view from the position indicated by circle 15' when the sun is approximately 19 degrees before noon time (i.e. 10:30 am). This figure shows shadows only of the elongated members.

Figure 2D:
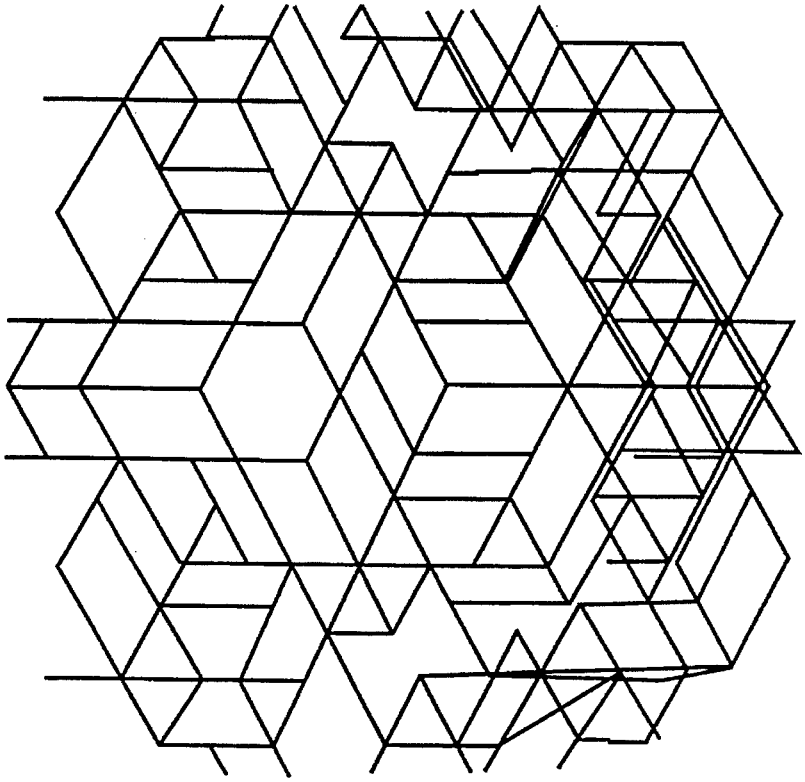
FIG. 2D illustrates the shadow pattern cast by the dome illustrated in FIG. 2A when the sun is approximately 19 degrees after noon.

FIG. 2D is a view of the dome and shadow pattern cast by the dome when the sun is approximately 19 degrees after noon time, indicated by the position of the sun in FIG. 2A by the circle 15". This corresponds to approximately 1:30 pm, and also shows shadows only of the elongated members.

As can be seen from these Figures, which are computer generated drawings, the dome appears to be made out of three sided, four sided, or five sided components depending upon the perspective of a person looking at it, and this multiple perspective continues no matter where a person stands in relation to the structure. In addition, the shadows cast by the structure also exhibit this characteristic as the sun passes over the structure.

FIGS. 3–6 illustrate details of the quasicrystal architectural body according to the second embodiment of this invention. This embodiment relates to a quasicrystal architectural body constructed with plates 20. The plates 20 are connected together to form cells as will be described in (greater/further) detail hereinafter. This configuration has the advantage that the expense and exacting requirements of nodes and elongated members of, for example, the dome 10, can be avoided and more rigid quasicrystal structures can be built, which nevertheless retain all the visual properties of quasicrystal structures in general. In constructing a plate structure, the plates are first casted out of, for example, plastic or concrete compounds.

The particular material of which the plates are made is not essential to the present invention and may be made from a variety of materials having, for example, properties of rigidity such as plywood, concretes, and metals.

Figure 3:
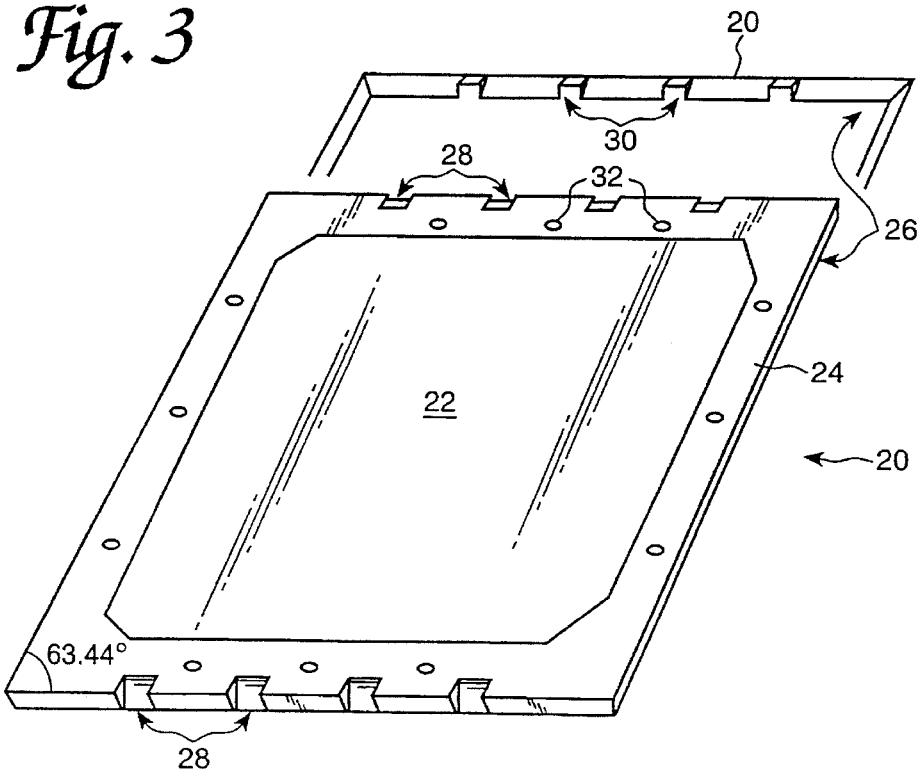
FIG. 3 is a plan view illustrating a plate used in the construction of a quasicrystal plate structure in accordance with the second embodiment of the present invention.

FIG. 3 illustrates a plate 20 connected to an adjacent plate to form a cell 40 or 42 as will be described hereinafter. The plate 20 comprises a central open area 22 encircled by a frame 24. As indicated, two corners of the frame 24 have an angle of 63.44 degrees while the other corners have an angle of 116.56 degrees. The perimeter edge of the frame 24 has a bevel 26 cut to facilitate connection to an adjacent plate to ensure precise interfitting of the plates and preserve the quasicrystal characteristic of the structure. The bevel 26 is cut at one half the dihedral angle of the cell for which the plate will be used as will be described hereinafter. At the connecting edge of the plate 20, there is provided a plurality of notches 28 which receive matching posts 30 from/of on an adjacent plate 22 to absorb any sheer force between adjacent plates. In addition, a plurality of bolt holes 32 are provided so that each face of the plates forming a cell are congruent with every other face.

Figure 4A:
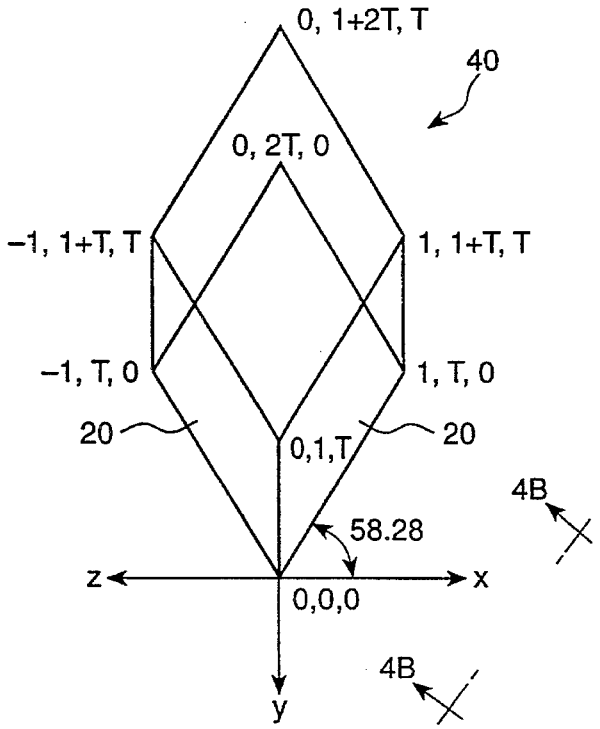
FIG. 4A is a top view of a first cell used in the construction of the plate quasicrystal architectural body according to the second embodiment of the present invention.
Figure 4B:
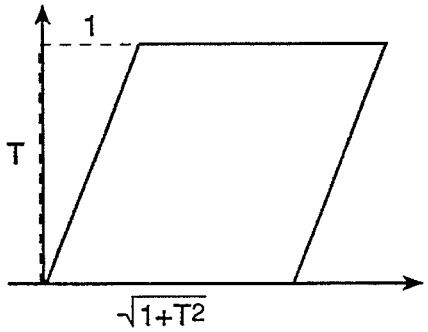
FIG. 4B is a side view of the first cell as seen from line 4B—4B of FIG. 4A.

FIGS. 4A–5B illustrate the two cells into which the plates are assembled. FIG. 4A illustrates an acute rhombic hexahedron cell 40. This cell has six faces, corresponding to the plate 20. All faces of the cell 40 are identical and have an acute angle of 63.44 degrees as described in conjunction with FIG. 3. The cell 40 has dihedral angles of 72 degrees and 108 degrees.

Figure 5A:
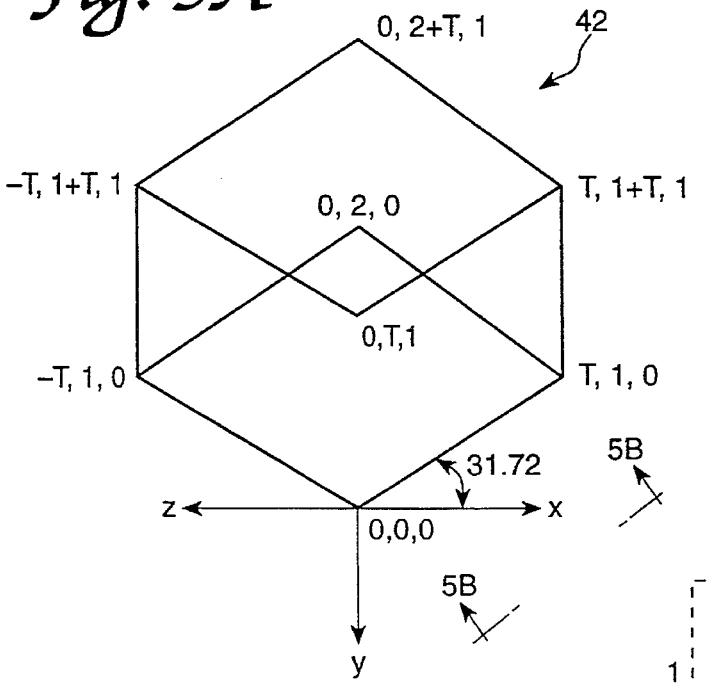
FIG. 5A is a top view of a second cell used in the construction of the quasicrystal plate architectural body according to the second embodiment of the present invention.
Figure 5B:
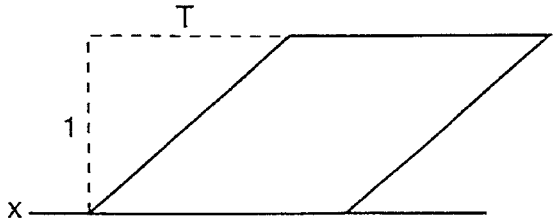
FIG. 5B is a side view of the second cell as seen from line 5B—5B of FIG. 5A.

FIGS. 5A and 5B illustrate the other cell 42 which is an obtuse rhombic hexahedron. The dihedral angles of this cell are 36 degrees and 144 degrees. Like cell 40, all six faces of the cell 42 correspond to the shape of the plate 20.

Figure 6:
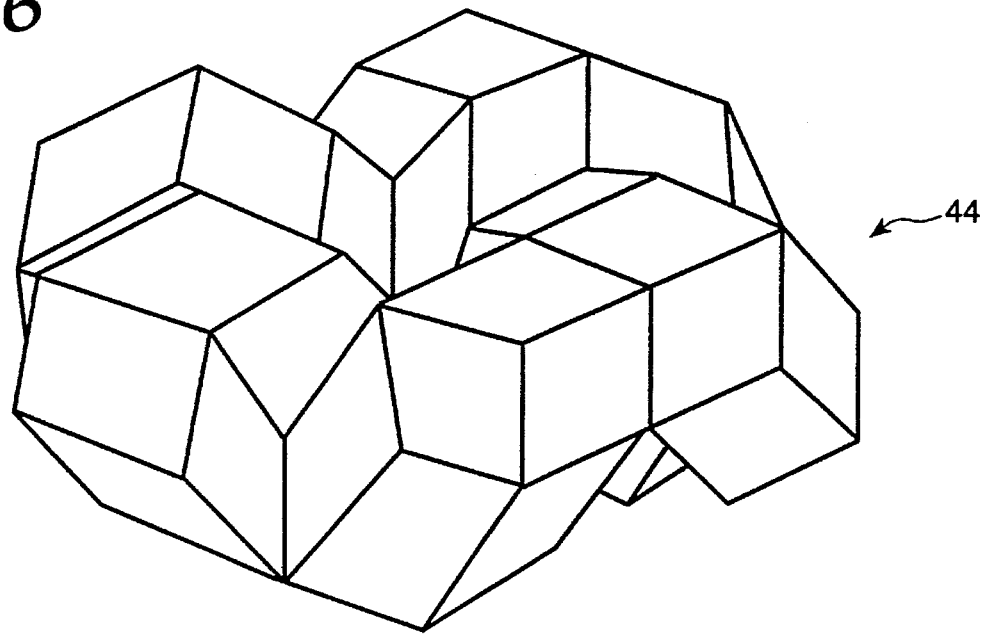
FIG. 6 is a perspective view of a quasicrystal architectural body constructed with plates according to the second embodiment of the present invention.

FIG. 6 is a perspective view of an architectural body 44 constructed with the cells 40 and 42. To be constructed, the cells 40 and 42 are hoisted and fastened into place by being bolted through the plates 20 until the entire structure is made. The computer program is also used to describe the relative spatial positions of the cells 40 and 42 to determine at what positions the cells 40 and 42 are interconnected. However, rather than using node and connect array data, this embodiment requires data describing the relative positions of the cells. Thus, though not provided herein, of the nodes constituting one cell, data concerning the spatial position of particular nodes may be used for connection relative to particular nodes of other cells.

The plates transfer force to and from each other by shear force along their mutual edges. This shear force is absorbed by the notch-post configuration described above. Aesthetically, open plates function as node and linear members while structurally, they function like solid plates. If filled with glass, or like clear plastic, the plates provide shelter while allowing light to pass through the plares.

Figure 7:
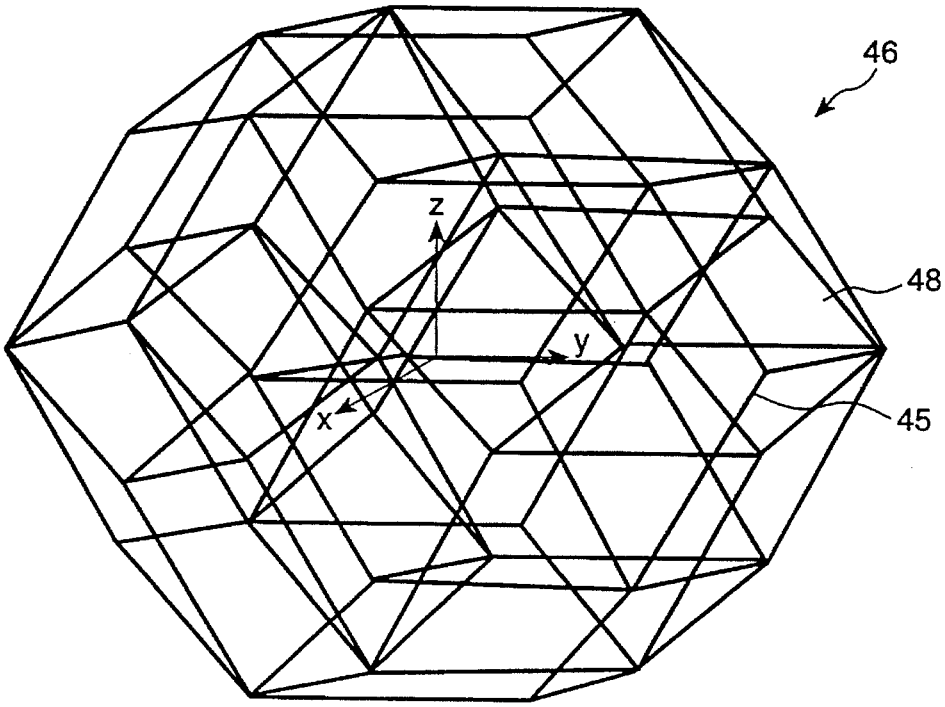
FIG. 7 is a perspective view of a lattice and membrane quasicrystal body according to the third embodiment of the present invention and illustrating a rhombic triacontahedron hull with a quasicrystal interior.

Referring now to FIG. 7, the third embodiment will now be described. It has been recognized that quasicrystal cells can be assembled into polyhedrals with symmetrical hulls or with hulls made of smooth surfaces. In this embodiment, a lattice structure is provided then covered by a tensile membrane. Since quasicrystals are non-repeating, any force applied to any part of the structure is quickly diffused through the structure and transferred throughout the skin as a whole, making the structure extremely strong. Specifically, any force applied to one location produces a reaction in another location and in a different direction from the original force. If the tensile membrane is strong enough to resist tearing, the resulting structure would be extremely lightweight yet very strong. The structure shown in FIG. 7 is a rhombic triacontahedron hull 46 having a quasicrystal interior. This structure is created with elongate linear members 45 from the connect array data in Table A3 and the nodes in Table A4. A tensile membrane 48 covers the hull as shown.

Many types of material may be used for the membrane 48. For example, mylar, fiberglass, polyvinyls, and polyethylenes and other similar materails may be used. It is important that the membrane 48 be a material that does not stretch, is resistant to puncture, and does not break down under extreme cold or heat and long term exposure to sunlight.

OPERATION AND USE

An architectural or other body can be constructed according to the present invention in one of three ways. First, a lattice type body is constructed by employing a computer program to generate the appropriated spatial data for the interconnection of elongated members used to construct the lattice. The elongated members are connected to each other by dodecahedral nodes to guarantee precise fitting of the members.

Second, a plate type quasicrystal body can be built by assembling plates into both acute and obtuse rhombic hexahedron cells. The hexahedron cells are hoisted and fastened together to form a particular architectural body.

Third, the lattice type body described above can be covered by a membrane material to form a lattice-membrane structure.

The above description is intended by way of example only and is not intended to limit the present invention in any way except as set forth in the following claims.

TABLE A1

| Node | X | Y | Z |
|---|---|---|---|
| 1 | 0.17 | 2.22 | 1.14 |
| 2 | 1.17 | 1.90 | 1.14 |
| 3 | −1.45 | 1.70 | 1.14 |
| 4 | 2.17 | 0.52 | 1.14 |
| 5 | −2.07 | 0.84 | 1.14 |
| 6 | 2.17 | −0.53 | 1.14 |
| 7 | −2.07 | −0.86 | 1.14 |
| 8 | 1.17 | −1.91 | 1.14 |
| 9 | −1.45 | −1.71 | 1.14 |
| 10 | 0.17 | −2.23 | 1.14 |
| 11 | −0.45 | 1.37 | 2.14 |
| 12 | 1.17 | 0.84 | 2.14 |
| 13 | −1.45 | −0.01 | 2.14 |
| 14 | 1.17 | −0.86 | 2.14 |
| 15 | −0.45 | −1.38 | 2.14 |
| 16 | −1.17 | 2.22 | 1.59 |
| 17 | 1.45 | 1.70 | 1.59 |
| 18 | −1.17 | 1.90 | 1.59 |
| 19 | 2.06 | 0.84 | 1.59 |
| 20 | −2.17 | 0.52 | 1.59 |
| 21 | 2.06 | −0.57 | 1.59 |
| 22 | −2.17 | −0.53 | 1.59 |
| 23 | 1.45 | −1.71 | 1.59 |
| 24 | −1.17 | −1.91 | 1.59 |
| 25 | −0.17 | −2.23 | 1.59 |
| 26 | −0.00 | 2.75 | 0.25 |
| 27 | 1.62 | 2.22 | 0.25 |
| 28 | −1.62 | 2.22 | 0.25 |
| 29 | 2.62 | 0.84 | 0.25 |
| 30 | −2.62 | −0.86 | 0.25 |
| 31 | 2.62 | −0.86 | 0.25 |
| 32 | −2.62 | −0.86 | 0.25 |
| 33 | −1.62 | −2.23 | 0.25 |
| 34 | −1.62 | −2.23 | 0.25 |
| 35 | −0.00 | 2.76 | 0.25 |
| 36 | 0.45 | 1.37 | 2.59 |
| 37 | −1.17 | 0.84 | 2.59 |
| 38 | 1.45 | −0.00 | 2.59 |
| 39 | −1.17 | −0.86 | 2.59 |
| 40 | 0.45 | −1.38 | 2.59 |
| 41 | 0.89 | 2.75 | 0.69 |
| 42 | −2.34 | 1.70 | 0.69 |
| 43 | 2.89 | −0.00 | 0.69 |
| 44 | −2.34 | −1.71 | 0.69 |
| 45 | 0.89 | −2.76 | 0.69 |
| 46 | 0.72 | 2.22 | 2.04 |
| 47 | −1.90 | 1.37 | 2.04 |
| 48 | 2.34 | −0.01 | 2.04 |
| 49 | −1.90 | −1.38 | 2.04 |
| 50 | 0.72 | −2.23 | 2.04 |
| 51 | −0.45 | 3.07 | 0.14 |
| 52 | −1.45 | 2.75 | 0.14 |
| 53 | 2.17 | 2.22 | 0.14 |
| 54 | 2.79 | 1.37 | 0.14 |
| 55 | −3.07 | 0.52 | 0.14 |
| 56 | −3.07 | −0.53 | 0.14 |
| 57 | 2.79 | −1.38 | 0.14 |
| 58 | 2.17 | −2.23 | 0.14 |
| 59 | −1.45 | −2.76 | 0.14 |
| 60 | −0.45 | −3.08 | 0.14 |
| 61 | −0.28 | 0.84 | 3.04 |
| 62 | 0.72 | 0.52 | 3.04 |
| 63 | −0.90 | −0.00 | 3.04 |
| 64 | 0.72 | −0.53 | 3.04 |
| 65 | −0.28 | −0.86 | 3.04 |
| 66 | −0.45 | 3.07 | 1.14 |
| 67 | −1.45 | 2.75 | 1.14 |
| 68 | −2.17 | 2.22 | 1.14 |
| 69 | 2.79 | 1.37 | 1.14 |
| 70 | −3.07 | 0.52 | 1.14 |
| 71 | −3.07 | −0.53 | 1.14 |
| 72 | 2.79 | −1.38 | 1.14 |
| 73 | 2.17 | −2.23 | 1.14 |
| 74 | −1.45 | −2.76 | 1.14 |
| 75 | −0.45 | −3.08 | 1.14 |
| 76 | −0.17 | 2.22 | 2.59 |
| 77 | 1.45 | 1.70 | 2.59 |

TABLE A1-continued

| Node | X | Y | Z |
|---|---|---|---|
| 78 | −1.17 | 1.90 | 2.59 |
| 79 | 2.06 | 0.84 | 2.59 |
| 80 | −2.17 | 0.53 | 2.59 |
| 81 | 2.06 | −0.86 | 2.59 |
| 82 | −2.17 | −0.53 | 2.59 |
| 83 | 1.45 | −1.71 | 2.59 |
| 84 | −1.17 | −1.91 | 2.59 |
| 85 | −0.17 | −2.23 | 2.59 |
| 86 | −0.00 | −0.00 | 3.48 |
| 87 | 0.45 | 3.07 | 1.59 |
| 88 | 1.45 | 2.75 | 1.59 |
| 89 | −2.17 | 2.22 | 1.59 |
| 90 | −2.79 | 1.37 | 1.59 |
| 91 | 3.06 | 0.52 | 1.59 |
| 92 | 3.06 | −0.53 | 1.59 |
| 93 | −2.79 | −1.38 | 1.59 |
| 94 | −2.17 | −2.23 | 1.59 |
| 95 | 1.45 | −2.75 | 1.59 |
| 96 | 0.45 | −3.08 | 1.59 |
| 97 | −0.90 | 2.75 | 2.04 |
| 98 | 2.34 | 1.70 | 2.04 |
| 99 | −2.90 | −0.00 | 2.04 |
| 100 | 2.34 | −1.71 | 2.04 |
| 101 | −0.90 | −2.76 | 2.04 |
| 102 | −0.90 | 1.66 | 3.04 |
| 103 | 1.72 | 0.84 | 3.04 |
| 104 | −1.90 | 0.32 | 3.04 |
| 105 | 1.72 | −0.86 | 3.04 |
| 106 | −0.90 | −1.71 | 3.04 |
| 107 | 0.28 | 3.60 | 0.69 |
| 108 | 1.89 | 3.07 | 0.69 |
| 109 | −2.34 | 2.73 | 0.69 |
| 110 | 3.51 | 0.84 | 0.69 |
| 111 | −3.34 | 1.37 | 0.69 |
| 112 | 3.51 | −0.86 | 0.69 |
| 113 | −3.34 | −1.38 | 0.69 |
| 114 | 1.89 | −3.08 | 0.69 |
| 115 | −2.34 | −2.76 | 0.69 |
| 116 | 0.28 | −3.61 | 0.69 |
| 117 | −1.62 | 2.22 | 2.48 |
| 118 | 2.62 | 0.84 | 2.48 |
| 119 | −2.62 | 0.84 | 2.48 |
| 120 | 2.62 | −0.86 | 2.48 |
| 121 | −1.62 | −2.23 | 2.48 |
| 122 | −0.01 | −2.76 | 2.48 |
| 123 | −0.45 | 3.07 | 2.14 |
| 124 | 2.17 | 2.22 | 2.14 |
| 125 | −3.07 | −0.53 | 2.14 |
| 126 | 2.17 | −2.23 | 2.14 |
| 127 | 1.17 | 3.60 | 0.14 |
| 128 | −3.07 | 2.22 | 0.14 |
| 129 | 3.79 | −0.00 | 0.14 |
| 130 | −3.07 | −2.23 | 0.14 |
| 131 | 1.17 | −3.61 | 0.14 |
| 132 | −1.17 | 3.60 | 0.59 |
| 133 | 0.72 | 2.22 | 3.04 |
| 134 | 3.06 | 2.22 | 0.59 |
| 135 | −1.90 | 1.37 | 3.04 |
| 136 | 2.34 | −0.00 | 3.04 |
| 137 | −3.79 | −0.00 | 0.59 |
| 138 | −1.90 | −1.38 | 3.04 |
| 139 | 0.72 | −2.33 | 3.04 |
| 140 | 3.06 | −2.33 | 0.59 |
| 141 | −1.17 | −3.61 | 0.59 |
| 142 | −0.00 | 1.70 | 3.48 |
| 143 | 1.00 | 1.37 | 3.48 |
| 144 | −1.00 | 1.37 | 3.48 |
| 145 | 1.62 | 0.52 | 3.48 |
| 146 | −1.62 | 0.52 | 3.48 |
| 147 | 1.62 | −0.53 | 3.48 |
| 148 | −1.62 | −0.53 | 3.48 |
| 149 | 1.00 | −1.38 | 3.48 |
| 150 | −1.00 | −1.38 | 3.48 |
| 151 | −0.00 | −1.71 | 3.48 |
| 152 | 1.17 | −3.60 | 1.14 |
| 153 | −3.07 | 2.22 | 1.14 |
| 154 | 3.79 | −0.01 | 1.14 |

TABLE A1-continued

| Node | X | Y | Z |
|---|---|---|---|
| 155 | −3.07 | −2.23 | 1.14 |
| 156 | 1.17 | −3.61 | 1.14 |
| 157 | 0.28 | 0.84 | 3.93 |
| 158 | −0.72 | 0.52 | 3.93 |
| 159 | 0.89 | −0.01 | 3.93 |
| 160 | −0.72 | −0.53 | 3.93 |
| 161 | 0.28 | −0.86 | 3.93 |
| 162 | 0.45 | 3.07 | 2.59 |
| 163 | 1.45 | 2.75 | 2.59 |
| 164 | −2.17 | 2.22 | 2.59 |
| 165 | 2.79 | 1.37 | 2.59 |
| 166 | 3.06 | 0.52 | 2.59 |
| 167 | 3.06 | −0.53 | 2.59 |
| 168 | −2.79 | −1.38 | 2.59 |
| 169 | −2.17 | −2.23 | 2.59 |
| 170 | 1.45 | −2.76 | 2.59 |
| 171 | 2.89 | 2.75 | 0.69 |
| 172 | 0.45 | −3.08 | 2.59 |
| 173 | −3.96 | 0.52 | 0.69 |
| 174 | −3.96 | −0.53 | 0.69 |
| 175 | 2.89 | −2.75 | 0.69 |
| 176 | −1.17 | 3.60 | 1.59 |
| 177 | 3.06 | 2.22 | 1.59 |
| 178 | −3.79 | −0.00 | 1.59 |
| 179 | 3.06 | −2.23 | 1.59 |
| 180 | −1.17 | −3.61 | 1.59 |
| 181 | −0.28 | 3.61 | 2.04 |
| 182 | 2.34 | 2.75 | 2.04 |
| 183 | 1.90 | 3.07 | 2.04 |
| 184 | 3.34 | 1.37 | 2.04 |
| 185 | −3.51 | 0.84 | 2.04 |
| 186 | 3.34 | −1.38 | 2.04 |
| 187 | −3.51 | −0.86 | 2.04 |

TABLE A2

| Linear Member | Node | Node |
|---|---|---|
| 1 | 1 | 41 |
| 2 | 1 | 87 |
| 3 | 2 | 41 |
| 4 | 2 | 88 |
| 5 | 3 | 42 |
| 6 | 3 | 89 |
| 7 | 4 | 43 |
| 8 | 4 | 91 |
| 9 | 5 | 42 |
| 10 | 5 | 90 |
| 11 | 6 | 43 |
| 12 | 6 | 92 |
| 13 | 7 | 44 |
| 14 | 7 | 93 |
| 15 | 8 | 45 |
| 16 | 8 | 95 |
| 17 | 9 | 44 |
| 18 | 9 | 94 |
| 19 | 10 | 45 |
| 20 | 10 | 96 |
| 21 | 11 | 36 |
| 22 | 11 | 37 |
| 23 | 11 | 76 |
| 24 | 11 | 78 |
| 25 | 12 | 36 |
| 26 | 12 | 38 |
| 27 | 12 | 77 |
| 28 | 12 | 79 |
| 29 | 13 | 37 |
| 30 | 13 | 39 |
| 31 | 13 | 80 |
| 32 | 13 | 82 |
| 33 | 14 | 38 |
| 34 | 14 | 40 |
| 35 | 14 | 81 |
| 36 | 14 | 83 |
| 37 | 15 | 39 |

TABLE A2-continued

| Linear Member | Node | Node |
|---|---|---|
| 38 | 15 | 40 |
| 39 | 15 | 84 |
| 40 | 15 | 85 |
| 41 | 16 | 46 |
| 42 | 16 | 66 |
| 43 | 16 | 76 |
| 44 | 16 | 97 |
| 45 | 17 | 46 |
| 46 | 17 | 77 |
| 47 | 17 | 98 |
| 48 | 18 | 47 |
| 49 | 18 | 67 |
| 50 | 18 | 78 |
| 51 | 18 | 97 |
| 52 | 19 | 48 |
| 53 | 19 | 69 |
| 54 | 19 | 79 |
| 55 | 19 | 98 |
| 56 | 20 | 47 |
| 57 | 20 | 70 |
| 58 | 20 | 80 |
| 59 | 20 | 99 |
| 60 | 21 | 92 |
| 61 | 22 | 49 |
| 62 | 22 | 71 |
| 63 | 22 | 82 |
| 64 | 22 | 99 |
| 65 | 23 | 50 |
| 66 | 23 | 73 |
| 67 | 23 | 83 |
| 68 | 23 | 100 |
| 69 | 24 | 49 |
| 70 | 24 | 74 |
| 71 | 24 | 84 |
| 72 | 24 | 101 |
| 73 | 25 | 50 |
| 74 | 25 | 75 |
| 75 | 25 | 85 |
| 76 | 25 | 101 |
| 77 | 26 | 41 |
| 78 | 26 | 107 |
| 79 | 27 | 41 |
| 80 | 27 | 108 |
| 81 | 28 | 42 |
| 82 | 28 | 109 |
| 83 | 29 | 43 |
| 84 | 29 | 110 |
| 85 | 30 | 44 |
| 86 | 30 | 113 |
| 87 | 31 | 43 |
| 88 | 31 | 112 |
| 89 | 32 | 44 |
| 90 | 32 | 113 |
| 91 | 33 | 44 |
| 92 | 33 | 115 |
| 93 | 34 | 44 |
| 94 | 34 | 115 |
| 95 | 35 | 41 |
| 96 | 35 | 107 |
| 97 | 36 | 61 |
| 98 | 36 | 62 |
| 99 | 36 | 133 |
| 100 | 37 | 61 |
| 101 | 37 | 63 |
| 102 | 37 | 104 |
| 103 | 37 | 135 |
| 104 | 38 | 62 |
| 105 | 38 | 64 |
| 106 | 38 | 103 |
| 107 | 38 | 105 |
| 108 | 38 | 136 |
| 109 | 39 | 63 |
| 110 | 39 | 65 |
| 111 | 39 | 106 |
| 112 | 39 | 138 |
| 113 | 40 | 64 |
| 114 | 40 | 65 |

TABLE A2-continued

| Linear Member | Node | Node |
|---|---|---|
| 115 | 42 | 153 |
| 116 | 43 | 154 |
| 117 | 44 | 155 |
| 118 | 45 | 152 |
| 119 | 45 | 156 |
| 120 | 46 | 87 |
| 121 | 46 | 88 |
| 122 | 46 | 133 |
| 123 | 47 | 89 |
| 124 | 47 | 90 |
| 125 | 47 | 117 |
| 126 | 47 | 119 |
| 127 | 47 | 135 |
| 128 | 48 | 91 |
| 129 | 48 | 92 |
| 130 | 48 | 118 |
| 131 | 48 | 120 |
| 132 | 48 | 136 |
| 133 | 49 | 93 |
| 134 | 49 | 94 |
| 135 | 49 | 121 |
| 136 | 49 | 138 |
| 137 | 50 | 95 |
| 138 | 50 | 96 |
| 139 | 50 | 122 |
| 140 | 50 | 139 |
| 141 | 51 | 66 |
| 142 | 51 | 132 |
| 143 | 52 | 67 |
| 144 | 52 | 132 |
| 145 | 53 | 134 |
| 146 | 54 | 69 |
| 147 | 54 | 134 |
| 148 | 55 | 70 |
| 149 | 55 | 137 |
| 150 | 56 | 71 |
| 151 | 56 | 137 |
| 152 | 57 | 72 |
| 153 | 58 | 73 |
| 154 | 58 | 140 |
| 155 | 59 | 74 |
| 156 | 59 | 141 |
| 157 | 60 | 75 |
| 158 | 60 | 141 |
| 159 | 61 | 86 |
| 160 | 61 | 142 |
| 161 | 61 | 144 |
| 162 | 62 | 86 |
| 163 | 62 | 143 |
| 164 | 62 | 145 |
| 165 | 63 | 86 |
| 166 | 63 | 146 |
| 167 | 63 | 148 |
| 168 | 64 | 86 |
| 169 | 64 | 147 |
| 170 | 64 | 149 |
| 171 | 65 | 86 |
| 172 | 65 | 150 |
| 173 | 65 | 151 |
| 174 | 66 | 87 |
| 175 | 66 | 107 |
| 176 | 66 | 123 |
| 177 | 66 | 176 |
| 178 | 67 | 89 |
| 179 | 67 | 109 |
| 180 | 67 | 176 |
| 181 | 69 | 91 |
| 182 | 69 | 110 |
| 183 | 69 | 177 |
| 184 | 70 | 90 |
| 185 | 70 | 111 |
| 186 | 70 | 173 |
| 187 | 70 | 178 |
| 188 | 71 | 93 |
| 189 | 71 | 113 |
| 190 | 71 | 125 |
| 191 | 71 | 174 |

TABLE A2-continued

| Linear Member | Node | Node |
|---|---|---|
| 192 | 71 | 178 |
| 193 | 72 | 92 |
| 194 | 72 | 112 |
| 195 | 72 | 179 |
| 196 | 73 | 95 |
| 197 | 73 | 114 |
| 198 | 73 | 126 |
| 199 | 73 | 175 |
| 200 | 73 | 179 |
| 201 | 74 | 94 |
| 202 | 74 | 115 |
| 203 | 74 | 180 |
| 204 | 75 | 96 |
| 205 | 75 | 116 |
| 206 | 75 | 180 |
| 207 | 76 | 102 |
| 208 | 76 | 123 |
| 209 | 76 | 133 |
| 210 | 77 | 103 |
| 211 | 77 | 124 |
| 212 | 77 | 133 |
| 213 | 78 | 135 |
| 214 | 79 | 136 |
| 215 | 80 | 135 |
| 216 | 81 | 136 |
| 217 | 82 | 104 |
| 218 | 82 | 125 |
| 219 | 82 | 138 |
| 220 | 83 | 105 |
| 221 | 83 | 126 |
| 222 | 84 | 138 |
| 223 | 85 | 106 |
| 224 | 85 | 139 |
| 225 | 86 | 157 |
| 226 | 86 | 158 |
| 227 | 86 | 159 |
| 228 | 86 | 160 |
| 229 | 86 | 161 |
| 230 | 87 | 162 |
| 231 | 87 | 181 |
| 232 | 88 | 163 |
| 233 | 88 | 182 |
| 234 | 89 | 153 |
| 235 | 89 | 164 |
| 236 | 89 | 183 |
| 237 | 90 | 153 |
| 238 | 90 | 185 |
| 239 | 91 | 154 |
| 240 | 91 | 166 |
| 241 | 91 | 184 |
| 242 | 92 | 154 |
| 243 | 92 | 167 |
| 244 | 92 | 186 |
| 245 | 93 | 155 |
| 246 | 93 | 168 |
| 247 | 93 | 187 |
| 248 | 94 | 155 |
| 249 | 94 | 169 |
| 250 | 95 | 152 |
| 251 | 95 | 156 |
| 252 | 95 | 170 |
| 253 | 96 | 152 |
| 254 | 96 | 156 |
| 255 | 96 | 172 |
| 256 | 97 | 117 |
| 257 | 97 | 176 |
| 258 | 98 | 118 |
| 259 | 98 | 177 |
| 260 | 99 | 119 |
| 261 | 99 | 178 |
| 262 | 100 | 120 |
| 263 | 100 | 179 |
| 264 | 101 | 121 |
| 265 | 101 | 122 |
| 266 | 101 | 180 |
| 267 | 102 | 142 |
| 268 | 103 | 143 |

TABLE A2-continued

| Linear Member | Node | Node |
|---|---|---|
| 269 | 104 | 148 |
| 270 | 105 | 149 |
| 271 | 106 | 151 |
| 272 | 109 | 153 |
| 273 | 110 | 154 |
| 274 | 111 | 153 |
| 275 | 112 | 154 |
| 276 | 113 | 155 |
| 277 | 114 | 152 |
| 278 | 114 | 156 |
| 279 | 115 | 155 |
| 280 | 116 | 152 |
| 281 | 116 | 156 |
| 282 | 117 | 183 |
| 283 | 118 | 184 |
| 284 | 119 | 185 |
| 285 | 120 | 186 |
| 286 | 122 | 139 |
| 287 | 123 | 162 |
| 288 | 124 | 163 |
| 289 | 125 | 168 |
| 290 | 126 | 170 |
| 291 | 128 | 153 |
| 292 | 129 | 154 |
| 293 | 130 | 155 |
| 294 | 131 | 152 |
| 295 | 131 | 156 |
| 296 | 132 | 176 |
| 297 | 133 | 142 |
| 298 | 133 | 143 |
| 299 | 133 | 162 |
| 300 | 133 | 163 |
| 301 | 134 | 177 |
| 302 | 135 | 144 |
| 303 | 135 | 146 |
| 304 | 135 | 164 |
| 305 | 136 | 145 |
| 306 | 136 | 147 |
| 307 | 136 | 166 |
| 308 | 136 | 167 |
| 309 | 137 | 178 |
| 310 | 138 | 148 |
| 311 | 138 | 150 |
| 312 | 138 | 168 |
| 313 | 138 | 169 |
| 314 | 140 | 179 |
| 315 | 141 | 180 |
| 316 | 142 | 157 |
| 317 | 143 | 157 |
| 318 | 144 | 158 |
| 319 | 145 | 159 |
| 320 | 146 | 158 |
| 321 | 147 | 159 |
| 322 | 148 | 160 |
| 323 | 149 | 161 |
| 324 | 150 | 160 |
| 325 | 151 | 161 |
| 326 | 176 | 181 |
| 327 | 176 | 183 |
| 328 | 177 | 182 |
| 329 | 177 | 184 |
| 330 | 178 | 185 |
| 331 | 178 | 187 |
| 332 | 179 | 186 |

TABLE A3

| Linear Member | Node | Node |
|---|---|---|
| 1 | 1 | 2 |
| 2 | 1 | 4 |
| 3 | 1 | 6 |
| 4 | 1 | 13 |
| 5 | 1 | 18 |
| 6 | 2 | 3 |

TABLE A3-continued

| Linear Member | Node | Node |
|---|---|---|
| 7 | 2 | 7 |
| 8 | 2 | 14 |
| 9 | 2 | 17 |
| 10 | 2 | 41 |
| 11 | 3 | 4 |
| 12 | 3 | 8 |
| 13 | 3 | 10 |
| 14 | 4 | 5 |
| 15 | 4 | 11 |
| 16 | 4 | 20 |
| 17 | 5 | 6 |
| 18 | 5 | 8 |
| 19 | 5 | 12 |
| 20 | 5 | 26 |
| 21 | 5 | 29 |
| 22 | 6 | 7 |
| 23 | 6 | 19 |
| 24 | 6 | 38 |
| 25 | 7 | 8 |
| 26 | 7 | 15 |
| 27 | 7 | 16 |
| 28 | 7 | 42 |
| 29 | 8 | 9 |
| 30 | 8 | 39 |
| 31 | 9 | 10 |
| 32 | 9 | 12 |
| 33 | 9 | 15 |
| 34 | 9 | 31 |
| 35 | 10 | 11 |
| 36 | 10 | 14 |
| 37 | 10 | 23 |
| 38 | 10 | 32 |
| 39 | 11 | 12 |
| 40 | 11 | 13 |
| 41 | 11 | 24 |
| 42 | 12 | 25 |
| 43 | 12 | 30 |
| 44 | 13 | 14 |
| 45 | 13 | 21 |
| 46 | 14 | 15 |
| 47 | 14 | 22 |
| 48 | 14 | 33 |
| 49 | 15 | 40 |
| 50 | 16 | 17 |
| 51 | 16 | 19 |
| 52 | 16 | 37 |
| 53 | 17 | 18 |
| 54 | 17 | 22 |
| 55 | 17 | 35 |
| 56 | 18 | 19 |
| 57 | 18 | 20 |
| 58 | 18 | 21 |
| 59 | 18 | 36 |
| 60 | 19 | 26 |
| 61 | 19 | 27 |
| 62 | 20 | 24 |
| 63 | 20 | 26 |
| 64 | 21 | 22 |
| 65 | 21 | 24 |
| 66 | 22 | 23 |
| 67 | 22 | 34 |
| 68 | 23 | 24 |
| 69 | 24 | 25 |
| 70 | 25 | 26 |
| 71 | 26 | 28 |
| 72 | 27 | 28 |
| 73 | 27 | 36 |
| 74 | 27 | 37 |
| 75 | 27 | 38 |
| 76 | 28 | 29 |
| 77 | 29 | 30 |
| 78 | 29 | 38 |
| 79 | 29 | 39 |
| 80 | 30 | 31 |
| 81 | 31 | 32 |
| 82 | 31 | 39 |
| 83 | 31 | 40 |

TABLE A3-continued

| Linear Member | Node | Node |
|---|---|---|
| 84 | 32 | 33 |
| 85 | 33 | 34 |
| 86 | 33 | 40 |
| 87 | 33 | 41 |
| 88 | 34 | 35 |
| 89 | 35 | 36 |
| 90 | 35 | 37 |
| 91 | 35 | 41 |
| 92 | 37 | 42 |
| 93 | 38 | 42 |
| 94 | 39 | 42 |
| 95 | 40 | 42 |
| 96 | 41 | 42 |

TABLE A4

| Node | X | Y | Z |
|---|---|---|---|
| 1 | 0.00 | 10.00 | −6.18 |
| 2 | 16.18 | 0.00 | −6.18 |
| 3 | 6.18 | 0.00 | 10.00 |
| 4 | −10.00 | 10.00 | 10.00 |
| 5 | −26.18 | 0.00 | 10.00 |
| 6 | −16.18 | 0.00 | −6.18 |
| 7 | 0.00 | −10.00 | −6.18 |
| 8 | −10.00 | −10.00 | 10.00 |
| 9 | 0.00 | −10.00 | 26.18 |
| 10 | 16.18 | 0.00 | 26.18 |
| 11 | 0.00 | 10.00 | 26.18 |
| 12 | −16.18 | 0.00 | 26.18 |
| 13 | 10.00 | 10.00 | 10.00 |

TABLE A4-continued

| Node | X | Y | Z |
|---|---|---|---|
| 14 | 26.18 | 0.00 | 10.00 |
| 15 | 10.00 | −10.00 | 10.00 |
| 16 | 0.00 | 6.18 | −16.18 |
| 17 | 16.18 | 16.18 | −16.18 |
| 18 | 0.00 | 26.18 | −16.18 |
| 19 | −16.18 | 16.18 | −16.18 |
| 20 | −10.00 | 26.18 | 0.00 |
| 21 | 10.00 | 26.18 | 0.00 |
| 22 | 26.18 | 16.18 | 0.00 |
| 23 | 16.18 | 16.18 | 16.18 |
| 24 | 0.00 | 26.18 | 16.18 |
| 25 | −16.18 | 16.18 | 16.18 |
| 26 | −26.18 | 16.18 | 0.00 |
| 27 | −16.18 | 0.00 | −26.18 |
| 28 | −26.18 | 0.00 | −10.00 |
| 29 | −26.18 | −16.18 | 0.00 |
| 30 | −16.18 | −16.18 | 16.18 |
| 31 | 0.00 | −26.18 | 16.18 |
| 32 | 16.18 | −16.18 | 16.18 |
| 33 | 26.18 | −16.18 | 0.00 |
| 34 | 26.18 | 0.00 | −10.00 |
| 35 | 16.18 | 0.00 | −26.18 |
| 36 | 0.00 | 10.00 | −26.18 |
| 37 | 0.00 | −10.00 | −26.18 |
| 38 | −16.18 | −16.18 | −16.18 |
| 39 | −10.00 | −26.18 | 0.00 |
| 40 | 10.00 | −26.18 | 0.00 |
| 41 | 16.18 | −16.18 | −16.18 |
| 42 | 0.00 | −26.18 | −16.18 |

APPENDIX

```
PROCEDURE DEFINE;
                                        V                A                R
B,J,I,ARGI,ANS:INTEGER;ARG,A1,A2,A3,A4,A5,A6,B1,B2,B3,B4,B5,B6,A,
INV,BB:REAL;

PROCEDURE LOOPS;
VAR I:INTEGER;
BEGIN
   I:= -25;
   REPEAT
    ARG := (I/A) + B1;
    ARGI := TRUNC(ARG);
    IF ARG <0 THEN ARGI := ARGI -1;
    B:= TRUNC(B1);
    IF B1 <0 THEN B:= B-1;
    PLANE[1,I]:=I+0.6180*ARGI+A1 -B*0.618 ;
    I:= I+1;
    UNTIL I = 26;

   I:= -25;
   REPEAT
    ARG := (I/A) + B2;
    ARGI := TRUNC(ARG);
    IF ARG <0 THEN ARGI := ARGI -1;
    B:= TRUNC(B2);
    IF B2 <0 THEN B:= B-1;
    PLANE[2,I]:=I+0.6180*ARGI+A2 -B*0.618 ;
    I:= I+1;
    UNTIL I = 26;

   I:= -25;
   REPEAT
    ARG := (I/A) + B3;
    ARGI := TRUNC(ARG);
    IF ARG <0 THEN ARGI := ARGI -1;
    B:= TRUNC(B3);
    IF B3 <0 THEN B:= B-1;
    PLANE[3,I]:=I+0.6180*ARGI+A3 -B*0.618 ;
    I:= I+1;
    UNTIL I = 26;

   I:= -25;
   REPEAT
    ARG := (I/A) + B4;
    ARGI := TRUNC(ARG);
    IF ARG <0 THEN ARGI := ARGI -1;
    B:= TRUNC(B4);
```

```
    IF B4 <0 THEN B:= B-1;
    PLANE[4,I]:=I+0.6180*ARGI+A4 -B*0.618 ;
    I:= I+1;
    UNTIL I = 26;

   I:= -25;
   REPEAT
    ARG := (I/A) + B5;
    ARGI := TRUNC(ARG);
    IF ARG <0 THEN ARGI := ARGI -1;
    B:= TRUNC(B5);
    IF B5 <0 THEN B:= B-1;
    PLANE[5,I]:=I+0.6180*ARGI+A5 -B*0.618 ;
    I:= I+1;
    UNTIL I = 26;

   I:= -25;
   REPEAT
    ARG := (I/A) + B6;
    ARGI := TRUNC(ARG);
    IF ARG <0 THEN ARGI := ARGI -1;
    B:= TRUNC(B6);
    IF B6 <0 THEN B:= B-1;
    PLANE[6,I]:=I+0.6180*ARGI+A6 -B*0.618 ;
    I:= I+1;
    UNTIL I = 26;
END;
BEGIN

    {PLANE [ ONE OF SIX DIRECTIONS, K OR ORDINAL POSITION] := VALUE
OF
            QUASIPERIODIC OR PERIODIC LEGNTH;
      THIS MEANS THAT FOR EVERY DIRECTION EVERY SLOT OR ORDINAL
POSITION
      OF THE ARRAY HAS ASSOCIATED WITH IT A REAL NUMBER WHICH IS

      ITS DISTANCE FROM THE ORIGIN }


  A:=1.618;  {tau is 1.618 1/tau is 0.6180}
WRITELN;
WRITELN('  CHOOSE BY NUMBER AND HIT RETURN ');
WRITELN('1:CHOOSE ALPHAS AND BETAS ');
WRITELN('2:CHOOSE DEFAULT ALPHAS AND BETAS ');
WRITELN('3:CHOOSE UNIT PERIODIC ALPHAS AND BETAS ');
READLN(ANS);
CASE ANS OF
1: BEGIN WRITELN(' A1 B1 ');
         READLN(A1,B1);
         WRITELN(' A2 B2 ');
         READLN(A2,B2);
         WRITELN(' A3 B3 ');
```

```
        READLN(A3,B3);
        WRITELN(' A4 B4 ');
        READLN(A4,B4);
        WRITELN(' A5 B5 ');
        READLN(A5,B5);
        WRITELN(' A6 B6 ');
        READLN(A6,B6);
        LOOPS;
    END;

2: BEGIN

A1:=0.6300;A2:=0.6300;A3:=0.6300;A4:=0.6300;A5:=0.6300;A6:=0.6300;

   B1:=-0.5;B2:=-0.5;B3:=-0.5;B4:=-0.5;B5:=-0.5;B6:=-0.5;  LOOPS;
END;

3: BEGIN
  WRITELN(' ENTER SHIFT FACTOR  -->RETURN');
  READLN(A1);
  FOR J:= 1 TO 6 DO BEGIN
  FOR I:= -25 TO 25 DO
  PLANE [J,I] := I + A1; END;END;

END;
writeln(plane[1,0]:8,plane[1,1]:8,plane[1,2]:8,plane[1,3]:8,plane
[1,4]:8,
plane[1,5]:8,plane[1,6]:8,plane[1,7]:8,plane[1,8]:8,plane[1,9]:8,
plane[1,10]:8);

           (*THE STAR VECTOR MATRIX*)
 BB:=2*(1/SQRT(5)); INV:=1/SQRT(5);
 E[1,1]:=BB;              E[1,2]:=0;               E[1,3]:=INV;
 E[2,1]:=BB*COS(2*PI/5); E[2,2]:=BB*SIN(2*PI/5); E[2,3]:=INV;
 E[3,1]:=BB*COS(4*PI/5); E[3,2]:=BB*SIN(4*PI/5); E[3,3]:=INV;
 E[4,1]:=BB*COS(6*PI/5); E[4,2]:=BB*SIN(6*PI/5); E[4,3]:=INV;
 E[5,1]:=BB*COS(8*PI/5); E[5,2]:=BB*SIN(8*PI/5); E[5,3]:=INV;
 E[6,1]:=0;               E[6,2]:=0;               E[6,3]:=1;


  END;


PROCEDURE DT(K:ROM;X:INTEGER);
    VAR   I:INTEGER;
 BEGIN
   FOR I:=1 TO 8 DO
   BEGIN
F1^[X,1,I]:=K[I,1]* E[1,1] + K[I,2] * E[2,1] + K[I,3] * E[3,1] +

            K[I,4]* E[4,1] + K[I,5] * E[5,1] + K[I,6] * E[6,1];
F1^[X,2,I]:=K[I,1]* E[1,2] + K[I,2] * E[2,2] + K[I,3] * E[3,2] +
```

```
            K[I,4]* E[4,2] + K[I,5] * E[5,2] + K[I,6] * E[6,2];
F1^[X,3,I]:=K[I,1]* E[1,3] + K[I,2] * E[2,3] + K[I,3] * E[3,3] +

            K[I,4]* E[4,3] + K[I,5] * E[5,3] + K[I,6] * E[6,3];
END;
{40 IS GOOD TOO}
IF  SQR(F1^[X,1,1]) + SQR(F1^[X,2,1]) + SQR(F1^[X,3,1])  < 30 THEN

PPLOT(X) ELSE NEXT :=NEXT -1; END;


PROCEDURE DIREC(A,B,C:INTEGER);
      {TAKES IN THE THREE DIRECTIONS AND DISCOVERS THE OTHER THREE}

VAR  I:INTEGER;DIR:ARRAY[1..6]  OF  INTEGER;LEGAL:ARRAY[1..6]  OF
BOOLEAN;
BEGIN

  FOR I := 1 TO 6 DO BEGIN
      DIR[I]:=I; LEGAL[I]:=TRUE; END;

  FOR I := 1 TO 6 DO
      IF A=DIR[I] THEN LEGAL[I] :=FALSE;
  FOR I := 1 TO 6 DO
      IF B=DIR[I] THEN LEGAL[I] :=FALSE;
  FOR I := 1 TO 6 DO
      IF C=DIR[I] THEN LEGAL[I] :=FALSE;

 I:=0;
 REPEAT
   I:=I+1;  IF  LEGAL[I]  THEN  DD:=  I  UNTIL  LEGAL[I];  LEGAL[I]:=
FALSE;
 I:=0;
 REPEAT
   I:=I+1;  IF  LEGAL[I]  THEN  EE:=  I  UNTIL  LEGAL[I];  LEGAL[I]:=
FALSE;
 I:=0;
 REPEAT
   I:=I+1; IF LEGAL[I] THEN FF:= I UNTIL LEGAL[I];
END;


FUNCTION FINDK( X:REAL; A:INTEGER): INTEGER;
VAR I:INTEGER;
BEGIN
 IF X < PLANE[A,-25] THEN BEGIN FINDK := -25;WRITELN('FINK TOO
LOW');END;
 FOR I :=-25 TO 24 DO BEGIN
  IF (X >=PLANE[A,I] ) AND (X < PLANE[A,I+1])  THEN FINDK := I;
   END;
 IF  X  >=PLANE[A,25]  THEN  BEGIN  FINDK  :=  25;WRITELN('FINDK  TOO
```

```
HIGH');END;
 END;

PROCEDURE RHOMBUS(A,B,C,K1,K2,K3,K4,K5,K6,:INTEGER);
      { SEVEN SIX-TUPLETS ARE COMPUTED FROM ONE KNOWN }
      { THE DIRECTIONS ARE PASSED THROUGH  ie ARBITRARY SET OF
DIRECTIONS}
      { R IS A 6x8 MATRIX THAT HOLDS THE KS FOR ONE RHOMBUS}
      { CALLS DT}
BEGIN

R[1,A]:=K1;  R[1,B]:=K2;  R[1,C]:=K3;  R[1,DD]:=K4; R[1,EE]:=K5;
R[1,FF]:=K6;
R[2,A]:=K1+1; R[2,B]:=K2;  R[2,C]:=K3;  R[2,DD]:=K4; R[2,EE]:=K5;
R[2,FF]:=K6;
R[3,A]:=K1;  R[3,B]:=K2+1; R[3,C]:=K3;  R[3,DD]:=K4; R[3,EE]:=K5;
R[3,FF]:=K6;
R[4,A]:=K1;  R[4,B]:=K2;  R[4,C]:=K3+1; R[4,DD]:=K4; R[4,EE]:=K5;
R[4,FF]:=K6;
R[5,A]:=K1+1; R[5,B]:=K2+1; R[5,C]:=K3;  R[5,DD]:=K4; R[5,EE]:=K5;
R[5,FF]:=K6;
R[6,A]:=K1+1; R[6,B]:=K2;  R[6,C]:=K3+1; R[6,DD]:=K4; R[6,EE]:=K5;
R[6,FF]:=K6;
R[7,A]:=K1;  R[7,B]:=K2+1; R[7,C]:=K3+1; R[7,DD]:=K4; R[7,EE]:=K5;
R[7,FF]:=K6;
R[8,A]:=K1+1; R[8,B]:=K2+1; R[8,C]:=K3+1; R[8,DD]:=K4; R[8,EE]:=K5;
R[8,FF]:=K6;


  DT(R,NEXT); {THE VERTICIES OF A RHOMBUS ARE COMPUTED AND SEND TO
F^ }

END;

PROCEDURE INTSECT(A,B,C,H,I,J:INTEGER);
     { A,B,C ARE THE THREE DIRECTION BEING CONSIDERED
       H I J ARE THE ORDINAL POSITIONS -THE KS -PLANES OF THE THREE
DIRECTIONS}

VAR  AX,AY,AZ,BX,BY,BZ,CX,CY,CZ,AAX,AAY,AAZ,BBX,BBY:REAL;
     BBZ,CCX,CCY,CCZ,ISECX,ISECY,ISECZ,LL,MM,NN:REAL;
     r1,r2,r3:REAL;
     U:ARRAY[1..3,1..3] OF REAL;
     L,M,N,XI:INTEGER;
     CONTINUE:BOOLEAN;
BEGIN
        { Uabc =Eb x Ec/ (Ea* (Eb x Ec)
          Ubca =Ec x Ea/ (Eb* (Ec x Ea)
          Ucab =Ea x Eb/ (Ec* (Ea x Eb)

           AX  AY  AZ   AX  AY
           BX  BY  BZ   BX  BY
```

```
            CX  CY  CZ   CX  CY )


A X : = E [ A , 1 ] ; A Y : = E [ A , 2 ] ; A Z : = E [ A , 3 ] ;
BX:=E[B,1];BY:=E[B,2];BZ:=E[B,3];
CX:=E[C,1];CY:=E[C,2];CZ:=E[C,3];

  {EQUATION FOR Uabc}
NUM:=AX * ((BY * CZ) - ( BZ * CY)) +
     AY * ((BZ * CX) - ( CZ * BX)) +
     AZ * ((BX * CY) - ( CX * BY)) ;

     CCX:=CX/NUM; CCY:=CY/NUM; CCZ:=CZ/NUM;

     U[1,1]:= (BY * CCZ) - (BZ * CCY);
     U[1,2]:= (BZ * CCX) - (BX * CCZ);
     U[1,3]:= (BX * CCY) - (BY * CCX);


  {EQUATION FOR Ubca}
NUM:=BX * ((CY * AZ) - ( CZ * AY)) +
     BY * ((CZ * AX) - ( AZ * CX)) +
     BZ * ((CX * AY) - ( AX * CY)) ;

     AAX:=AX/NUM; AAY:=AY/NUM; AAZ:=AZ/NUM;

     U[2,1]:= (CY * AAZ) - (CZ * AAY);
     U[2,2]:= (CZ * AAX) - (CX * AAZ);
     U[2,3]:= (CX * AAY) - (CY * AAX);


  {EQUATION FOR Ucab}
NUM:=CX * ((AY * BZ) - ( AZ * BY)) +
     CY * ((AZ * BX) - ( BZ * AX)) +
     CZ * ((AX * BY) - ( BX * AY)) ;

     BBX:=BX/NUM; BBY:=BY/NUM; BBZ:=BZ/NUM;

     U[3,1]:= (AY * BBZ) - (AZ * BBY);
     U[3,2]:= (AZ * BBX) - (AX * BBZ);
     U[3,3]:= (AX * BBY) - (AY * BBX);

r1:=plane[a,h];r2:=plane[b,i];r3:=plane[c,j];
ISECX:=(r1*U[1,1]) + (r2*U[2,1]) + (r3*U[3,1]);
ISECY:=(r1*U[1,2]) + (r2*U[2,2]) + (r3*U[3,2]);
ISECZ:=(r1*U[1,3]) + (r2*U[2,3]) + (r3*U[3,3]);
(*****************
{CALCULATE THE DISTANCE FROM THE ORIGIN, IF ITS TOO FAR, DROP IT}

 IF ( SQR(ISECX) + SQR(ISECY) + SQR(ISECZ) ) < 20 THEN BEGIN
*******************)
```

```
  DIREC(A,B,C); {THE OTHER THREE DIRECTIONS ARE DISCOVERED}

  {CALCULATE THE LEGNTH ON THE OTHER THREE}
  {DOT ISECX ETC WITH EACH OTHER FROM STAR}

  LL:=(ISECX * E[DD,1]) + (ISECY * E[DD,2]) + (ISECZ * E[DD,3]);

  MM:=(ISECX * E[EE,1]) + (ISECY * E[EE,2]) + (ISECZ * E[EE,3]);

  NN:=(ISECX * E[FF,1]) + (ISECY * E[FF,2]) + (ISECZ * E[FF,3]);

  L:=FINDK(LL,DD);
  M:=FINDK(MM,EE);
  N:=FINDK(NN,FF);

  RHOMBUS(A,B,C,H,I,J,L,M,N); {THREE DIRECTIONS AND SIX KS}
  NEXT:=NEXT+1;
(********** END; {check distance}  *************)
END;


PROCEDURE FILL;          {LOOPS THROUGH THREE PLANE INTERSECTIONS
VIA THEIR }
VAR DIR,PLN,A,B,C,H,I,J:INTEGER; {ORDINAL POSITIONS - THEIR KS -AND
CALLS INTSECT EACH}
ANS:CHAR;
BEGIN

NEXT:=1;
FOR I := 1 TO 3 DO BEGIN
FOR J := 1 TO NPTS DO BEGIN
F^[I,J] :=0 ; END;END;

WRITELN;
WRITELN('DO YOU WISH TO DRAW THE WHOLE FIGURE? Y/N AND HIT
RETURN');
READLN(ANS);
IF ANS IN ['Y','y'] THEN BEGIN
     FOR A:= 1 TO 6 DO BEGIN
     FOR B:= 1 TO 6 DO BEGIN
     FOR C:= 1 TO 6 DO BEGIN

     { FOR EACH A NOT B NOT C IN ONLY ONE ORDER}
      IF (A<>B) AND (B<>C) AND (A<>C)
      AND (A<B) AND (B<C)

      THEN BEGIN    {0 TO 1}
     FOR H:= -1 TO 1 DO BEGIN
     FOR I:= -1 TO 1 DO BEGIN
     FOR J:= -1 TO 1 DO BEGIN

       INTSECT(A,B,C,H,I,J);
```

```
     END;END;END;{h i j}
     END; {if}
     END;END;END; {a b c}
     END  {whole figure}
     ELSE BEGIN
WRITELN(' CHOOSE A PLANE');
READLN(PLN);
     FOR A:= 1 TO 4 DO BEGIN
     FOR B:= A+1 TO 5 DO BEGIN
     FOR I:= -3 TO +3 DO BEGIN
     FOR J:= -3 TO +3 DO BEGIN

       INTSECT(A,B,6,I,J,PLN);

     END;END;{ i j}
     END;END; { b c}
     END; {else}

 WRITELN(F1^[1,3,1]:12, F1^[1,3,2]:12,F1^[2,3,1]:12);
 WRITELN(F1^[5,3,1]:12, F1^[5,3,2]:12,F1^[9,3,3]:12);

     NUMU:=NEXT-1;
     WRITELN( NUMU,' NUMBER OF UNITS');

END;  {proc}


PROCEDURE CALC;   (*MAIN PROC *)
BEGIN
              CLEAR;
  DEFINE;       { CALLS PERIODIC OR QUASIPERIODIC FUNCTIONS}
  FILL;         {CALLS INTERSECT WHICH CALLS RHOMBUS WHICH CALLS
DT}
  SET_DIS;
  MENUE;
END;
^ZOR QUASIPERIODIC FUNCTIONS}
```

I claim:

1. An architectural body having a structure with an outer surface in the form of one of a dome, space frame, vault and sphere supported above an underlying surface with an intervening space defined between the body and the underlying surface:

i) said body having the properties a) of icosahedral symmetry, b) of non-periodicity c) of a load imposed on part of the structure of the body being diffused in all directions throughout the structure of the body as opposed to being translated directly through the structure of the body, d) of passing light throughout the structure of the body, e) of casting shadows on the underlying surface when light is passed through the structure of the body and said intervening space, f) of flexibility, and g) of having several geometrical shapes in the same place and the same time as revealed by rotation;

ii) said body being composed solely of a set of two groups of six-sided three dimensional cells having six sides and vertices with all of the sides of all of the cells being geometrically in the form of a single rhombus having opposed corner angles of 63.44 degrees and 116.56 degrees;

iii) the cells of the two groups differing only as to their dihedral angles with the cells of one group having dihedral angles of 36 degrees and 144 degrees and the cells of the other group having dihedral angles of 72 degrees and 108 degrees;

iv) said set of two groups of six-sided three dimensional cells being physically joined together selectively in a spatial arrangement to form a non-triangulated internal reaction structure at least one cell deep in a manner to achieve the above enumerated properties a) through g) of the body;

v) said body having a spatial arrangement of the cells such that the vertices of the cells register with some of the vertices of all the vertices that would be generated by an algorithm implementing the deBruijn dual method within a space including the architectural body;

vi) and the spatial arrangement of the cells of the body being such that all of the cells are located a distance greater than a predetermined minimum distance from a preselected spatial origin.

2. An architectural body as set forth in claim 1 having the further property of the structure of the body changing its apparent shape with movement of a viewer on the underlying surface relative to the body or relative movement of light passing through the body and intervening space which casts shadows on the underlying surface.

3. An architectural body as defined in claim 2 wherein a non-flexible membrane covers the outer surface of the architectural body.

4. An architectural body as set forth in claim 2 wherein each side of each cell consists of a plate consisting of an outer frame having a perimeter edge and a central opening, the perimeter edge of the frame having a bevel cut at one-half the dihedral angle of the cell, for which the plate is used, to interfit with adjacent plates.

5. An architectural body as set forth in claim 4 wherein interfitting plates of each cell are provided with pluralities of mutually cooperating notches and matching posts to absorb shear forces between adjacent plates.

6. An architectural body as defined claim 4 wherein central openings of the plates present on the outer surface of the body are filled with a transparent liquid impervious material.

7. An architectural body according to claim 2 wherein the algorithm is a computer algorithm as follows:

```
PROCEDURE DEFINE;
                                        V                   A                   R
B,J,I,ARGI,ANS:INTEGER;ARG,A1,A2,A3,A4,A5,A6,B1,B2,B3,B4,B5,B6,A,
INV,BB:REAL;

PROCEDURE LOOPS;
VAR I:INTEGER;
BEGIN
   I:= -25;
   REPEAT
    ARG := (I/A) + B1;
    ARGI := TRUNC(ARG);
    IF ARG <0 THEN ARGI := ARGI -1;
    B:= TRUNC(B1);
    IF B1 <0 THEN B:= B-1;
    PLANE[1,I]:=I+0.6180*ARGI+A1 -B*0.618 ;
    I:= I+1;
    UNTIL I = 26;

   I:= -25;
   REPEAT
    ARG := (I/A) + B2;
    ARGI := TRUNC(ARG);
    IF ARG <0 THEN ARGI := ARGI -1;
    B:= TRUNC(B2);
    IF B2 <0 THEN B:= B-1;
    PLANE[2,I]:=I+0.6180*ARGI+A2 -B*0.618 ;
    I:= I+1;
    UNTIL I = 26;

   I:= -25;
   REPEAT
    ARG := (I/A) + B3;
    ARGI := TRUNC(ARG);
    IF ARG <0 THEN ARGI := ARGI -1;
    B:= TRUNC(B3);
    IF B3 <0 THEN B:= B-1;
    PLANE[3,I]:=I+0.6180*ARGI+A3 -B*0.618 ;
    I:= I+1;
    UNTIL I = 26;

   I:= -25;
   REPEAT
    ARG := (I/A) + B4;
    ARGI := TRUNC(ARG);
    IF ARG <0 THEN ARGI := ARGI -1;
    B:= TRUNC(B4);
```

```
    IF B4 <0 THEN B:= B-1;
    PLANE[4,I]:=I+0.6180*ARGI+A4 -B*0.618 ;
    I:= I+1;
    UNTIL I = 26;

   I:= -25;
   REPEAT
    ARG := (I/A) + B5;
    ARGI := TRUNC(ARG);
    IF ARG <0 THEN ARGI := ARGI -1;
    B:= TRUNC(B5);
    IF B5 <0 THEN B:= B-1;
    PLANE[5,I]:=I+0.6180*ARGI+A5 -B*0.618 ;
    I:= I+1;
    UNTIL I = 26;

   I:= -25;
   REPEAT
    ARG := (I/A) + B6;
    ARGI := TRUNC(ARG);
    IF ARG <0 THEN ARGI := ARGI -1;
    B:= TRUNC(B6);
    IF B6 <0 THEN B:= B-1;
    PLANE[6,I]:=I+0.6180*ARGI+A6 -B*0.618 ;
    I:= I+1;
    UNTIL I = 26;
END;
BEGIN

    {PLANE [ ONE OF SIX DIRECTIONS, K OR ORDINAL POSITION] := VALUE
OF
              QUASIPERIODIC OR PERIODIC LEGNTH;
      THIS MEANS THAT FOR EVERY DIRECTION EVERY SLOT OR ORDINAL
POSITION
      OF THE ARRAY HAS ASSOCIATED WITH IT A REAL NUMBER WHICH IS

      ITS DISTANCE FROM THE ORIGIN }


  A:=1.618;  {tau is 1.618 1/tau is 0.6180}
WRITELN;
WRITELN('  CHOOSE BY NUMBER AND HIT RETURN ');
WRITELN('1:CHOOSE ALPHAS AND BETAS ');
WRITELN('2:CHOOSE DEFAULT ALPHAS AND BETAS ');
WRITELN('3:CHOOSE UNIT PERIODIC ALPHAS AND BETAS ');
READLN(ANS);
CASE ANS OF
1: BEGIN WRITELN(' A1 B1 ');
         READLN(A1,B1);
         WRITELN(' A2 B2 ');
         READLN(A2,B2);
         WRITELN(' A3 B3 ');
```

```
        READLN(A3,B3);
        WRITELN(' A4 B4 ');
        READLN(A4,B4);
        WRITELN(' A5 B5 ');
        READLN(A5,B5);
        WRITELN(' A6 B6 ');
        READLN(A6,B6);
        LOOPS;
    END;

2: BEGIN

A1:=0.6300;A2:=0.6300;A3:=0.6300;A4:=0.6300;A5:=0.6300;A6:=0.6300;

   B1:=-0.5;B2:=-0.5;B3:=-0.5;B4:=-0.5;B5:=-0.5;B6:=-0.5;  LOOPS;
END;

3: BEGIN
  WRITELN(' ENTER SHIFT FACTOR  -->RETURN');
  READLN(A1);
  FOR J:= 1 TO 6 DO BEGIN
  FOR I:= -25 TO 25 DO
  PLANE [J,I] := I + A1; END;END;

END;
writeln(plane[1,0]:8,plane[1,1]:8,plane[1,2]:8,plane[1,3]:8,plane
[1,4]:8,
plane[1,5]:8,plane[1,6]:8,plane[1,7]:8,plane[1,8]:8,plane[1,9]:8,
plane[1,10]:8);

          (*THE STAR VECTOR MATRIX*)
 BB:=2*(1/SQRT(5)); INV:=1/SQRT(5);
 E[1,1]:=BB;              E[1,2]:=0;                E[1,3]:=INV;
 E[2,1]:=BB*COS(2*PI/5); E[2,2]:=BB*SIN(2*PI/5); E[2,3]:=INV;
 E[3,1]:=BB*COS(4*PI/5); E[3,2]:=BB*SIN(4*PI/5); E[3,3]:=INV;
 E[4,1]:=BB*COS(6*PI/5); E[4,2]:=BB*SIN(6*PI/5); E[4,3]:=INV;
 E[5,1]:=BB*COS(8*PI/5); E[5,2]:=BB*SIN(8*PI/5); E[5,3]:=INV;
 E[6,1]:=0;               E[6,2]:=0;                E[6,3]:=1;


  END;


PROCEDURE DT(K:ROM;X:INTEGER);
    VAR   I:INTEGER;
 BEGIN
   FOR I:=1 TO 8 DO
   BEGIN
F1^[X,1,I]:=K[I,1]* E[1,1] + K[I,2] * E[2,1] + K[I,3] * E[3,1] +

            K[I,4]* E[4,1] + K[I,5] * E[5,1] + K[I,6] * E[6,1];
F1^[X,2,I]:=K[I,1]* E[1,2] + K[I,2] * E[2,2] + K[I,3] * E[3,2] +
```

F' cont

```
            K[I,4]* E[4,2] + K[I,5] * E[5,2] + K[I,6] * E[6,2];
F1^[X,3,I]:=K[I,1]* E[1,3] + K[I,2] * E[2,3] + K[I,3] * E[3,3] +

            K[I,4]* E[4,3] + K[I,5] * E[5,3] + K[I,6] * E[6,3];
END;

IF  SQR(F1^[X,1,1]) + SQR(F1^[X,2,1]) + SQR(F1^[X,3,1])  < 30 THEN

PPLOT(X) ELSE NEXT :=NEXT -1; END;


PROCEDURE DIREC(A,B,C:INTEGER);
      {TAKES IN THE THREE DIRECTIONS AND DISCOVERS THE OTHER THREE}

VAR  I:INTEGER;DIR:ARRAY[1..6]  OF  INTEGER;LEGAL:ARRAY[1..6]  OF
BOOLEAN;
BEGIN

  FOR I := 1 TO 6 DO BEGIN
      DIR[I]:=I; LEGAL[I]:=TRUE; END;

  FOR I := 1 TO 6 DO
      IF A=DIR[I] THEN LEGAL[I] :=FALSE;
  FOR I := 1 TO 6 DO
      IF B=DIR[I] THEN LEGAL[I] :=FALSE;
  FOR I := 1 TO 6 DO
      IF C=DIR[I] THEN LEGAL[I] :=FALSE;

 I:=0;
 REPEAT
   I:=I+1;  IF  LEGAL[I]  THEN  DD:=  I  UNTIL  LEGAL[I];  LEGAL[I]:=
FALSE;
 I:=0;
 REPEAT
   I:=I+1;  IF  LEGAL[I]  THEN  EE:=  I  UNTIL  LEGAL[I];  LEGAL[I]:=
FALSE;
 I:=0;
 REPEAT
   I:=I+1; IF LEGAL[I] THEN FF:= I UNTIL LEGAL[I];
END;


FUNCTION FINDK( X:REAL; A:INTEGER): INTEGER;
VAR I:INTEGER;
BEGIN
 IF X < PLANE[A,-25] THEN BEGIN FINDK := -25;WRITELN('FINK TOO
LOW');END;
 FOR I :=-25 TO 24 DO BEGIN
  IF (X >=PLANE[A,I] ) AND (X < PLANE[A,I+1])  THEN FINDK := I;
   END;
 IF  X  >=PLANE[A,25]  THEN  BEGIN  FINDK  :=  25;WRITELN('FINDK  TOO
```

F1 cont

```
HIGH');END;
 END;

PROCEDURE RHOMBUS(A,B,C,K1,K2,K3,K4,K5,K6,:INTEGER);
      { SEVEN SIX-TUPLETS ARE COMPUTED FROM ONE KNOWN }
      { THE DIRECTIONS ARE PASSED THROUGH  ie ARBITRARY SET OF
DIRECTIONS}
      { R IS A 6x8 MATRIX THAT HOLDS THE KS FOR ONE RHOMBUS}
      { CALLS DT}
BEGIN

R[1,A]:=K1;  R[1,B]:=K2;  R[1,C]:=K3;  R[1,DD]:=K4; R[1,EE]:=K5;
R[1,FF]:=K6;
R[2,A]:=K1+1; R[2,B]:=K2;  R[2,C]:=K3;  R[2,DD]:=K4; R[2,EE]:=K5;
R[2,FF]:=K6;
R[3,A]:=K1;  R[3,B]:=K2+1; R[3,C]:=K3;  R[3,DD]:=K4; R[3,EE]:=K5;
R[3,FF]:=K6;
R[4,A]:=K1;  R[4,B]:=K2;  R[4,C]:=K3+1; R[4,DD]:=K4; R[4,EE]:=K5;
R[4,FF]:=K6;
R[5,A]:=K1+1; R[5,B]:=K2+1; R[5,C]:=K3;  R[5,DD]:=K4; R[5,EE]:=K5;
R[5,FF]:=K6;
R[6,A]:=K1+1; R[6,B]:=K2;  R[6,C]:=K3+1; R[6,DD]:=K4; R[6,EE]:=K5;
R[6,FF]:=K6;
R[7,A]:=K1;  R[7,B]:=K2+1; R[7,C]:=K3+1; R[7,DD]:=K4; R[7,EE]:=K5;
R[7,FF]:=K6;
R[8,A]:=K1+1; R[8,B]:=K2+1; R[8,C]:=K3+1; R[8,DD]:=K4; R[8,EE]:=K5;
R[8,FF]:=K6;


  DT(R,NEXT); (THE VERTICIES OF A RHOMBUS ARE COMPUTED AND SEND TO
F^ }

END;

PROCEDURE INTSECT(A,B,C,H,I,J:INTEGER);
     { A,B,C ARE THE THREE DIRECTION BEING CONSIDERED
       H I J ARE THE ORDINAL POSITIONS -THE KS -PLANES OF THE THREE
DIRECTIONS}

VAR  AX,AY,AZ,BX,BY,BZ,CX,CY,CZ,AAX,AAY,AAZ,BBX,BBY:REAL;
     BBZ,CCX,CCY,CCZ,ISECX,ISECY,ISECZ,LL,MM,NN:REAL;
     r1,r2,r3:REAL;
     U:ARRAY[1..3,1..3] OF REAL;
     L,M,N,XI:INTEGER;
     CONTINUE:BOOLEAN;
BEGIN
        { Uabc =Eb x Ec/ (Ea* (Eb x Ec)
          Ubca =Ec x Ea/ (Eb* (Ec x Ea)
          Ucab =Ea x Eb/ (Ec* (Ea x Eb)

           AX  AY  AZ   AX  AY
           BX  BY  BZ   BX  BY
```

F1 cont

```
          CX  CY  CZ   CX  CY )


A X : = E [ A , 1 ] ; A Y : = E [ A , 2 ] ; A Z : = E [ A , 3 ] ;
BX:=E[B,1];BY:=E[B,2];BZ:=E[B,3];
CX:=E[C,1];CY:=E[C,2];CZ:=E[C,3];

  {EQUATION FOR Uabc}
NUM:=AX * ((BY * CZ) - ( BZ * CY)) +
     AY * ((BZ * CX) - ( CZ * BX)) +
     AZ * ((BX * CY) - ( CX * BY)) ;

     CCX:=CX/NUM; CCY:=CY/NUM; CCZ:=CZ/NUM;

     U[1,1]:= (BY * CCZ) - (BZ * CCY);
     U[1,2]:= (BZ * CCX) - (BX * CCZ);
     U[1,3]:= (BX * CCY) - (BY * CCX);


  {EQUATION FOR Ubca}
NUM:=BX * ((CY * AZ) - ( CZ * AY)) +
     BY * ((CZ * AX) - ( AZ * CX)) +
     BZ * ((CX * AY) - ( AX * CY)) ;

     AAX:=AX/NUM; AAY:=AY/NUM; AAZ:=AZ/NUM;

     U[2,1]:= (CY * AAZ) - (CZ * AAY);
     U[2,2]:= (CZ * AAX) - (CX * AAZ);
     U[2,3]:= (CX * AAY) - (CY * AAX);


  {EQUATION FOR Ucab}
NUM:=CX * ((AY * BZ) - ( AZ * BY)) +
     CY * ((AZ * BX) - ( BZ * AX)) +
     CZ * ((AX * BY) - ( BX * AY)) ;

     BBX:=BX/NUM; BBY:=BY/NUM; BBZ:=BZ/NUM;

     U[3,1]:= (AY * BBZ) - (AZ * BBY);
     U[3,2]:= (AZ * BBX) - (AX * BBZ);
     U[3,3]:= (AX * BBY) - (AY * BBX);

r1:=plane[a,h];r2:=plane[b,i];r3:=plane[c,j];
ISECX:=(r1*U[1,1]) + (r2*U[2,1]) + (r3*U[3,1]);
ISECY:=(r1*U[1,2]) + (r2*U[2,2]) + (r3*U[3,2]);
ISECZ:=(r1*U[1,3]) + (r2*U[2,3]) + (r3*U[3,3]);
(*****************
{CALCULATE THE DISTANCE FROM THE ORIGIN, IF ITS TOO FAR, DROP IT}

 IF ( SQR(ISECX) + SQR(ISECY) + SQR(ISECZ) ) < 20 THEN BEGIN
*******************)
```

```
  DIREC(A,B,C); {THE OTHER THREE DIRECTIONS ARE DISCOVERED}

  {CALCULATE THE LEGNTH ON THE OTHER THREE}
  {DOT ISECX ETC WITH EACH OTHER FROM STAR}

  LL:=(ISECX * E[DD,1]) + (ISECY * E[DD,2]) + (ISECZ * E[DD,3]);

  MM:=(ISECX * E[EE,1]) + (ISECY * E[EE,2]) + (ISECZ * E[EE,3]);

  NN:=(ISECX * E[FF,1]) + (ISECY * E[FF,2]) + (ISECZ * E[FF,3]);

  L:=FINDK(LL,DD);
  M:=FINDK(MM,EE);
  N:=FINDK(NN,FF);

  RHOMBUS(A,B,C,H,I,J,L,M,N); {THREE DIRECTIONS AND SIX KS}
  NEXT:=NEXT+1;
(**********  END; {check distance}  *************)
END;


PROCEDURE FILL;          {LOOPS THROUGH THREE PLANE INTERSECTIONS
VIA THEIR }
VAR DIR,PLN,A,B,C,H,I,J:INTEGER; {ORDINAL POSITIONS - THEIR KS -AND
CALLS INTSECT EACH}
ANS:CHAR;
BEGIN

NEXT:=1;
FOR I := 1 TO 3 DO BEGIN
FOR J := 1 TO NPTS DO BEGIN
F^[I,J] :=0 ; END;END;

WRITELN;
WRITELN('DO YOU WISH TO DRAW THE WHOLE FIGURE? Y/N AND HIT
RETURN');
READLN(ANS);
IF ANS IN ['Y','y'] THEN BEGIN
     FOR A:= 1 TO 6 DO BEGIN
     FOR B:= 1 TO 6 DO BEGIN
     FOR C:= 1 TO 6 DO BEGIN

     { FOR EACH A NOT B NOT C IN ONLY ONE ORDER}
      IF (A<>B) AND (B<>C) AND (A<>C)
      AND (A<B) AND (B<C)

      THEN BEGIN    {0 TO 1}
     FOR H:= -1 TO 1 DO BEGIN
     FOR I:= -1 TO 1 DO BEGIN
     FOR J:= -1 TO 1 DO BEGIN

       INTSECT(A,B,C,H,I,J);
```

F' cont

```
     END;END;END;{h i j}
     END; {if}
     END;END;END; {a b c}
     END  {whole figure}
     ELSE BEGIN
WRITELN(' CHOOSE A PLANE');
READLN(PLN);
     FOR A:= 1 TO 4 DO BEGIN
     FOR B:= A+1 TO 5 DO BEGIN
     FOR I:= -3 TO +3 DO BEGIN
     FOR J:= -3 TO +3 DO BEGIN

       INTSECT(A,B,6,I,J,PLN);

     END;END;{ i j}
     END;END; { b c}
     END; {else}

 WRITELN(F1^[1,3,1]:12, F1^[1,3,2]:12,F1^[2,3,1]:12);
 WRITELN(F1^[5,3,1]:12, F1^[5,3,2]:12,F1^[9,3,3]:12);

     NUMU:=NEXT-1;
     WRITELN( NUMU,' NUMBER OF UNITS');

END;  {proc}


PROCEDURE CALC;   (*MAIN PROC *)
BEGIN
              CLEAR;
  DEFINE;       { CALLS PERIODIC OR QUASIPERIODIC FUNCTIONS}
  FILL;         {CALLS INTERSECT WHICH CALLS RHOMBUS WHICH CALLS
DT}
  SET_DIS;
  MENUE;
END;
^ZOR QUASIPERIODIC FUNCTIONS}
```

F1 cont

8. A method for making an architectural body comprising the steps of:

i) preparing a set of only two groups of six-sided three dimensional cells having six sides, vertices and perimeter edges with all of the sides of all of the cells being in the form of a single thombus having opposed corner angles of 63.44 degrees and 116.56 degrees, ii) preparing the cells of one group with dihedral angles of 36 degrees and 144 degrees, iii) preparing the cells of the other group with dihedral angles of 72 degrees and 108 degrees, iv) physically joining the set of two groups of six-sided three dimensional cells together selectively in a spatial arrangement to form a non-triangulated internal reaction structure at least one cell deep, v) organizing the spatial arrangement of the cells such that the vertices of the cells register with some of the vertices of all the vertices that would be generated by an algorithm implementing the deBruijn dual method within a space including the cells, vi) erecting and supporting the cells of the two groups of six-sided three dimensional cells in the spatial arrangement above an underlying surface with an intervening space therebetween such that all of the cells are located a distance greater than a predetermined minimum distance from a preselected spatial origin to achieve an architectural body in the form of one of a dome, space frame, vault and sphere; and vii) imparting to the architectural body the properties of a) icosahedral symmetry, b) non-periodicity, c) a load imposed on part of the structure of the body being diffused in all directions as opposed to being translated directly through the structure of the body, d) passing light throughout the structure of the body, e) casting shadows on the underlying surface when light is passed through the structure of the body and the intervening space flexibility, and g) having several geometrical shapes in the same place and the same time as revealed by rotation.

9. A method according to claim 8, including imparting to the body the further property of the shape of the body appearing to change with movement of a viewer on the underlying surface relative to the body or movement relative to the body of light passing through the body and the intervening space which casts shadows on the underlying surface.

10. A method according to claim 8 including the further step of covering the outer surface of the architectural body with a non-flexible membrane.

11. A method according to claim 8 including using for each side of each cell a plate consisting of an outer frame defining a central opening and having a bevelled perimeter.

12. A method according to claim 11 including filling the central opening of each plate is filled with a transparent, liquid impervious material.

13. A method according to claim 8 including constructing the cells using only dodecahedral connecting nodes having pentagonal faces with centers and a hole in the center of each pentagonal face, spatially located at the vertices of the cells, and a plurality of elongated members, each having a connecting pin at each end, with the connecting pins being received in holes of said nodes with said plurality of elongated members being present only along the perimeter edges of the cells and without any elongated member extending in a diagonal direction of the cell in which it is present.

14. The method of claim 8 wherein the algorithm is a computer algorithm as follows:

```
PROCEDURE DEFINE;
                                        V                   A                   R
B,J,I,ARGI,ANS:INTEGER;ARG,A1,A2,A3,A4,A5,A6,B1,B2,B3,B4,B5,B6,A,
INV,BB:REAL;

PROCEDURE LOOPS;
VAR I:INTEGER;
BEGIN
   I:= -25;
   REPEAT
    ARG := (I/A) + B1;
    ARGI := TRUNC(ARG);
    IF ARG <0 THEN ARGI := ARGI -1;
    B:= TRUNC(B1);
    IF B1 <0 THEN B:= B-1;
    PLANE[1,I]:=I+0.6180*ARGI+A1 -B*0.618 ;
    I:= I+1;
    UNTIL I = 26;

   I:= -25;
   REPEAT
    ARG := (I/A) + B2;
    ARGI := TRUNC(ARG);
    IF ARG <0 THEN ARGI := ARGI -1;
    B:= TRUNC(B2);
    IF B2 <0 THEN B:= B-1;
    PLANE[2,I]:=I+0.6180*ARGI+A2 -B*0.618 ;
    I:= I+1;
    UNTIL I = 26;

   I:= -25;
   REPEAT
    ARG := (I/A) + B3;
    ARGI := TRUNC(ARG);
    IF ARG <0 THEN ARGI := ARGI -1;
    B:= TRUNC(B3);
    IF B3 <0 THEN B:= B-1;
    PLANE[3,I]:=I+0.6180*ARGI+A3 -B*0.618 ;
    I:= I+1;
    UNTIL I = 26;

   I:= -25;
   REPEAT
    ARG := (I/A) + B4;
    ARGI := TRUNC(ARG);
    IF ARG <0 THEN ARGI := ARGI -1;
    B:= TRUNC(B4);
```

```
    IF B4 <0 THEN B:= B-1;
    PLANE[4,I]:=I+0.6180*ARGI+A4 -B*0.618 ;
    I:= I+1;
    UNTIL I = 26;

   I:= -25;
   REPEAT
    ARG := (I/A) + B5;
    ARGI := TRUNC(ARG);
    IF ARG <0 THEN ARGI := ARGI -1;
    B:= TRUNC(B5);
    IF B5 <0 THEN B:= B-1;
    PLANE[5,I]:=I+0.6180*ARGI+A5 -B*0.618 ;
    I:= I+1;
    UNTIL I = 26;

   I:= -25;
   REPEAT
    ARG := (I/A) + B6;
    ARGI := TRUNC(ARG);
    IF ARG <0 THEN ARGI := ARGI -1;
    B:= TRUNC(B6);
    IF B6 <0 THEN B:= B-1;
    PLANE[6,I]:=I+0.6180*ARGI+A6 -B*0.618 ;
    I:= I+1;
    UNTIL I = 26;
END;
BEGIN

    {PLANE [ ONE OF SIX DIRECTIONS, K OR ORDINAL POSITION] := VALUE
OF
            QUASIPERIODIC OR PERIODIC LEGNTH;
      THIS MEANS THAT FOR EVERY DIRECTION EVERY SLOT OR ORDINAL
POSITION
      OF THE ARRAY HAS ASSOCIATED WITH IT A REAL NUMBER WHICH IS

      ITS DISTANCE FROM THE ORIGIN }


  A:=1.618;  {tau is 1.618 1/tau is 0.6180}
WRITELN;
WRITELN('  CHOOSE BY NUMBER AND HIT RETURN ');
WRITELN('1:CHOOSE ALPHAS AND BETAS ');
WRITELN('2:CHOOSE DEFAULT ALPHAS AND BETAS ');
WRITELN('3:CHOOSE UNIT PERIODIC ALPHAS AND BETAS ');
READLN(ANS);
CASE ANS OF
1: BEGIN WRITELN(' A1 B1 ');
         READLN(A1,B1);
         WRITELN(' A2 B2 ');
         READLN(A2,B2);
         WRITELN(' A3 B3 ');
```

```
        READLN(A3,B3);
        WRITELN(' A4 B4 ');
        READLN(A4,B4);
        WRITELN(' A5 B5 ');
        READLN(A5,B5);
        WRITELN(' A6 B6 ');
        READLN(A6,B6);
        LOOPS;
    END;

2: BEGIN

A1:=0.6300;A2:=0.6300;A3:=0.6300;A4:=0.6300;A5:=0.6300;A6:=0.6300;

   B1:=-0.5;B2:=-0.5;B3:=-0.5;B4:=-0.5;B5:=-0.5;B6:=-0.5;  LOOPS;
END;

3: BEGIN
  WRITELN(' ENTER SHIFT FACTOR  -->RETURN');
  READLN(A1);
  FOR J:= 1 TO 6 DO BEGIN
  FOR I:= -25 TO 25 DO
  PLANE [J,I] := I + A1; END;END;

END;
writeln(plane[1,0]:8,plane[1,1]:8,plane[1,2]:8,plane[1,3]:8,plane
[1,4]:8,
plane[1,5]:8,plane[1,6]:8,plane[1,7]:8,plane[1,8]:8,plane[1,9]:8,
plane[1,10]:8);

            (*THE STAR VECTOR MATRIX*)
 BB:=2*(1/SQRT(5)); INV:=1/SQRT(5);
 E[1,1]:=BB;              E[1,2]:=0;                E[1,3]:=INV;
 E[2,1]:=BB*COS(2*PI/5); E[2,2]:=BB*SIN(2*PI/5); E[2,3]:=INV;
 E[3,1]:=BB*COS(4*PI/5); E[3,2]:=BB*SIN(4*PI/5); E[3,3]:=INV;
 E[4,1]:=BB*COS(6*PI/5); E[4,2]:=BB*SIN(6*PI/5); E[4,3]:=INV;
 E[5,1]:=BB*COS(8*PI/5); E[5,2]:=BB*SIN(8*PI/5); E[5,3]:=INV;
 E[6,1]:=0;               E[6,2]:=0;                E[6,3]:=1;


  END;


PROCEDURE DT(K:ROM;X:INTEGER);
    VAR   I:INTEGER;
 BEGIN
   FOR I:=1 TO 8 DO
   BEGIN
F1^[X,1,I]:=K[I,1]* E[1,1] + K[I,2] * E[2,1] + K[I,3] * E[3,1] +

            K[I,4]* E[4,1] + K[I,5] * E[5,1] + K[I,6] * E[6,1];
F1^[X,2,I]:=K[I,1]* E[1,2] + K[I,2] * E[2,2] + K[I,3] * E[3,2] +
```

```
            K[I,4]* E[4,2] + K[I,5] * E[5,2] + K[I,6] * E[6,2];
F1^[X,3,I]:=K[I,1]* E[1,3] + K[I,2] * E[2,3] + K[I,3] * E[3,3] +

            K[I,4]* E[4,3] + K[I,5] * E[5,3] + K[I,6] * E[6,3];
END;

IF  SQR(F1^[X,1,1]) + SQR(F1^[X,2,1]) + SQR(F1^[X,3,1])  < 30 THEN

PPLOT(X) ELSE NEXT :=NEXT -1; END;


PROCEDURE DIREC(A,B,C:INTEGER);
      {TAKES IN THE THREE DIRECTIONS AND DISCOVERS THE OTHER THREE}

VAR  I:INTEGER;DIR:ARRAY[1..6]  OF  INTEGER;LEGAL:ARRAY[1..6]  OF
BOOLEAN;
BEGIN

  FOR I := 1 TO 6 DO BEGIN
      DIR[I]:=I; LEGAL[I]:=TRUE; END;

  FOR I := 1 TO 6 DO
      IF A=DIR[I] THEN LEGAL[I] :=FALSE;
  FOR I := 1 TO 6 DO
      IF B=DIR[I] THEN LEGAL[I] :=FALSE;
  FOR I := 1 TO 6 DO
      IF C=DIR[I] THEN LEGAL[I] :=FALSE;

 I:=0;
 REPEAT
   I:=I+1;  IF  LEGAL[I]  THEN  DD:=  I  UNTIL  LEGAL[I];  LEGAL[I]:=
FALSE;
 I:=0;
 REPEAT
   I:=I+1;  IF  LEGAL[I]  THEN  EE:=  I  UNTIL  LEGAL[I];  LEGAL[I]:=
FALSE;
 I:=0;
 REPEAT
   I:=I+1; IF LEGAL[I] THEN FF:= I UNTIL LEGAL[I];
END;


FUNCTION FINDK( X:REAL; A:INTEGER): INTEGER;
VAR I:INTEGER;
BEGIN
 IF X < PLANE[A,-25] THEN BEGIN FINDK := -25;WRITELN('FINK TOO
LOW');END;
 FOR I :=-25 TO 24 DO BEGIN
  IF (X >=PLANE[A,I] ) AND (X < PLANE[A,I+1])  THEN FINDK := I;
   END;
 IF  X  >=PLANE[A,25]  THEN  BEGIN  FINDK  :=  25;WRITELN('FINDK  TOO
```

```
HIGH');END;
 END;

PROCEDURE RHOMBUS(A,B,C,K1,K2,K3,K4,K5,K6,:INTEGER);
      { SEVEN SIX-TUPLETS ARE COMPUTED FROM ONE KNOWN }
      { THE DIRECTIONS ARE PASSED THROUGH  ie ARBITRARY SET OF
DIRECTIONS}
      { R IS A 6x8 MATRIX THAT HOLDS THE KS FOR ONE RHOMBUS}
      { CALLS DT}
BEGIN

R[1,A]:=K1;  R[1,B]:=K2;  R[1,C]:=K3;  R[1,DD]:=K4; R[1,EE]:=K5;
R[1,FF]:=K6;
R[2,A]:=K1+1; R[2,B]:=K2;  R[2,C]:=K3;  R[2,DD]:=K4; R[2,EE]:=K5;
R[2,FF]:=K6;
R[3,A]:=K1;  R[3,B]:=K2+1; R[3,C]:=K3;  R[3,DD]:=K4; R[3,EE]:=K5;
R[3,FF]:=K6;
R[4,A]:=K1;  R[4,B]:=K2;  R[4,C]:=K3+1; R[4,DD]:=K4; R[4,EE]:=K5;
R[4,FF]:=K6;
R[5,A]:=K1+1; R[5,B]:=K2+1; R[5,C]:=K3;  R[5,DD]:=K4; R[5,EE]:=K5;
R[5,FF]:=K6;
R[6,A]:=K1+1; R[6,B]:=K2;  R[6,C]:=K3+1; R[6,DD]:=K4; R[6,EE]:=K5;
R[6,FF]:=K6;
R[7,A]:=K1;  R[7,B]:=K2+1; R[7,C]:=K3+1; R[7,DD]:=K4; R[7,EE]:=K5;
R[7,FF]:=K6;
R[8,A]:=K1+1; R[8,B]:=K2+1; R[8,C]:=K3+1; R[8,DD]:=K4; R[8,EE]:=K5;
R[8,FF]:=K6;


  DT(R,NEXT); {THE VERTICIES OF A RHOMBUS ARE COMPUTED AND SEND TO
F' }

END;

PROCEDURE INTSECT(A,B,C,H,I,J:INTEGER);
     { A,B,C ARE THE THREE DIRECTION BEING CONSIDERED
       H I J ARE THE ORDINAL POSITIONS -THE KS -PLANES OF THE THREE
DIRECTIONS}

VAR  AX,AY,AZ,BX,BY,BZ,CX,CY,CZ,AAX,AAY,AAZ,BBX,BBY:REAL;
     BBZ,CCX,CCY,CCZ,ISECX,ISECY,ISECZ,LL,MM,NN:REAL;
     r1,r2,r3:REAL;
     U:ARRAY[1..3,1..3] OF REAL;
     L,M,N,XI:INTEGER;
     CONTINUE:BOOLEAN;
BEGIN
        { Uabc =Eb x Ec/ (Ea* (Eb x Ec)
          Ubca =Ec x Ea/ (Eb* (Ec x Ea)
          Ucab =Ea x Eb/ (Ec* (Ea x Eb)

           AX  AY  AZ   AX  AY
           BX  BY  BZ   BX  BY
```

```
          CX  CY  CZ   CX  CY )

A X : = E [ A , 1 ] ; A Y : = E [ A , 2 ] ; A Z : = E [ A , 3 ] ;
BX:=E[B,1];BY:=E[B,2];BZ:=E[B,3];
CX:=E[C,1];CY:=E[C,2];CZ:=E[C,3];

  {EQUATION FOR Uabc}
NUM:=AX * ((BY * CZ) - ( BZ * CY)) +
     AY * ((BZ * CX) - ( CZ * BX)) +
     AZ * ((BX * CY) - ( CX * BY)) ;

     CCX:=CX/NUM; CCY:=CY/NUM; CCZ:=CZ/NUM;

     U[1,1]:= (BY * CCZ) - (BZ * CCY);
     U[1,2]:= (BZ * CCX) - (BX * CCZ);
     U[1,3]:= (BX * CCY) - (BY * CCX);


  {EQUATION FOR Ubca}
NUM:=BX * ((CY * AZ) - ( CZ * AY)) +
     BY * ((CZ * AX) - ( AZ * CX)) +
     BZ * ((CX * AY) - ( AX * CY)) ;

     AAX:=AX/NUM; AAY:=AY/NUM; AAZ:=AZ/NUM;

     U[2,1]:= (CY * AAZ) - (CZ * AAY);
     U[2,2]:= (CZ * AAX) - (CX * AAZ);
     U[2,3]:= (CX * AAY) - (CY * AAX);


  {EQUATION FOR Ucab}
NUM:=CX * ((AY * BZ) - ( AZ * BY)) +
     CY * ((AZ * BX) - ( BZ * AX)) +
     CZ * ((AX * BY) - ( BX * AY)) ;

     BBX:=BX/NUM; BBY:=BY/NUM; BBZ:=BZ/NUM;

     U[3,1]:= (AY * BBZ) - (AZ * BBY);
     U[3,2]:= (AZ * BBX) - (AX * BBZ);
     U[3,3]:= (AX * BBY) - (AY * BBX);

r1:=plane[a,h];r2:=plane[b,i];r3:=plane[c,j];
ISECX:=(r1*U[1,1]) + (r2*U[2,1]) + (r3*U[3,1]);
ISECY:=(r1*U[1,2]) + (r2*U[2,2]) + (r3*U[3,2]);
ISECZ:=(r1*U[1,3]) + (r2*U[2,3]) + (r3*U[3,3]);
(******************
{CALCULATE THE DISTANCE FROM THE ORIGIN, IF ITS TOO FAR, DROP IT}

 IF ( SQR(ISECX) + SQR(ISECY) + SQR(ISECZ) ) < 20 THEN BEGIN
********************)
```

```
  DIREC(A,B,C); {THE OTHER THREE DIRECTIONS ARE DISCOVERED}

  {CALCULATE THE LEGNTH ON THE OTHER THREE}
  {DOT ISECX ETC WITH EACH OTHER FROM STAR}

  LL:=(ISECX * E[DD,1]) + (ISECY * E[DD,2]) + (ISECZ * E[DD,3]);

  MM:=(ISECX * E[EE,1]) + (ISECY * E[EE,2]) + (ISECZ * E[EE,3]);

  NN:=(ISECX * E[FF,1]) + (ISECY * E[FF,2]) + (ISECZ * E[FF,3]);

  L:=FINDK(LL,DD);
  M:=FINDK(MM,EE);
  N:=FINDK(NN,FF);

  RHOMBUS(A,B,C,H,I,J,L,M,N); {THREE DIRECTIONS AND SIX KS}
  NEXT:=NEXT+1;
(********** END; {check distance}  *************)
END;


PROCEDURE FILL;          {LOOPS THROUGH THREE PLANE INTERSECTIONS
VIA THEIR }
VAR DIR,PLN,A,B,C,H,I,J:INTEGER; {ORDINAL POSITIONS - THEIR KS -AND
CALLS INTSECT EACH}
ANS:CHAR;
BEGIN

NEXT:=1;
FOR I := 1 TO 3 DO BEGIN
FOR J := 1 TO NPTS DO BEGIN
F^[I,J] :=0 ; END;END;

WRITELN;
WRITELN('DO YOU WISH TO DRAW THE WHOLE FIGURE? Y/N AND HIT
RETURN');
READLN(ANS);
IF ANS IN ['Y','y'] THEN BEGIN
     FOR A:= 1 TO 6 DO BEGIN
     FOR B:= 1 TO 6 DO BEGIN
     FOR C:= 1 TO 6 DO BEGIN

     { FOR EACH A NOT B NOT C IN ONLY ONE ORDER}
      IF (A<>B) AND (B<>C) AND (A<>C)
      AND (A<B) AND (B<C)

      THEN BEGIN    {0 TO 1}
     FOR H:= -1 TO 1 DO BEGIN
     FOR I:= -1 TO 1 DO BEGIN
     FOR J:= -1 TO 1 DO BEGIN

       INTSECT(A,B,C,H,I,J);
```

F' cont

```
     END;END;END;{h i j}
     END; {if}
     END;END;END; {a b c}
     END  {whole figure}
     ELSE BEGIN
WRITELN(' CHOOSE A PLANE');
READLN(PLN);
     FOR A:= 1 TO 4 DO BEGIN
     FOR B:= A+1 TO 5 DO BEGIN
     FOR I:= -3 TO +3 DO BEGIN
     FOR J:= -3 TO +3 DO BEGIN

       INTSECT(A,B,6,I,J,PLN);

     END;END;{ i j}
     END;END; { b c}
     END; {else}

 WRITELN(F1^[1,3,1]:12, F1^[1,3,2]:12,F1^[2,3,1]:12);
 WRITELN(F1^[5,3,1]:12, F1^[5,3,2]:12,F1^[9,3,3]:12);

     NUMU:=NEXT-1;
     WRITELN( NUMU,' NUMBER OF UNITS');

END;  {proc}


PROCEDURE CALC;   (*MAIN PROC *)
BEGIN
              CLEAR;
  DEFINE;       { CALLS PERIODIC OR QUASIPERIODIC FUNCTIONS}
  FILL;          {CALLS INTERSECT WHICH CALLS RHOMBUS WHICH CALLS
DT}
  SET_DIS;
  MENUE;
END;
^ZOR QUASIPERIODIC FUNCTIONS}
```

15. An architectural body having a structure in the form of one of a dome, space frame, vault and sphere supported above an underlying surface with an intervening space defined between the body and the underlying surface:

i) said body having the properties a) of icosahedral symmetry, b) of non-periodicity c) of a load imposed on part of the structure of the body being diffused in all directions throughout the structure of the body as opposed to being translated directly through the structure of the body, d) of passing light throughout the structure of the body, e) of casting shadows on the underlying surface when light is passed through the structure of the body and said intervening space, f) of flexibility, and g) of the structure of the body changing its apparent shape with movement of a viewer on the underlying surface or movement relative to the body of light passing through the body and the intervening space which casts shadows on the underlying surface;

ii) said body being composed solely of a set of two groups of six-sided three dimensional cells having six sides, vertices and perimeter edges with all of the sides of all of the cells being geometrically in the form of a single thombus having opposed corner angles of 63.44 degrees and 116.56 degrees;

iii) the cells of the two groups differing only as to their dihedral angles with the cells of one group having dihedral angles of 36 degrees and 144 degrees and the cells of the other group having dihedral angles of 72 degrees and 108 degrees;

iv) said set of two groups of six-sided three dimensional cells being physically joined together selectively to form a non-triangulated internal reaction structure at least one cell deep in a manner to achieve the above enumerated properties a) through g) of the body;

v) said cells consisting of cell defining structure consisting of dodecahedral connecting nodes having pentagonal faces with centers and a hole in the center of each pentagonal face, said nodes being spatially located at the vertices of the cells and a plurality of elongated members, each having a connecting pin at each end, with the connecting pins being received in the holes of said nodes;

vi) said plurality of elongated members being present only along the perimeter edges of the cells; and without any elongated member extending in a diagonal direction of a cell in which it is present vii) the cells being arranged spatially in a spatial arrangement such that the vertices of the cells register with some of the vertices of all the vertices that would be generated by an algorithm implementing the deBruijn dual method within a space including the architectural body; and viii) the spatial arrangement of the ceils of the body being such that all of the cells are located a distance greater than a predetermined minimum distance from a preselected spatial origin.

* * * * *